United States Patent [19]

Sato et al.

[11] 4,439,513

[45] Mar. 27, 1984

[54] COLOR PHOTOGRAPHIC LIGHT-SENSITIVE MATERIAL WITH NAPHTHOL REDOX DYE RELEASER

[75] Inventors: Kozo Sato; Shinsaku Fujita; Hideki Naito; Hiroshi Hara, all of Kanagawa, Japan

[73] Assignee: Fuji Photo Film Co., Ltd., Kanagawa, Japan

[21] Appl. No.: 453,975

[22] Filed: Dec. 28, 1982

[30] Foreign Application Priority Data

Dec. 29, 1981 [JP] Japan ..... 56-213111

[51] Int. Cl.[3] ..... G03C 1/40; G03C 1/10; G03C 5/54

[52] U.S. Cl. ..... 430/203; 430/223; 430/242; 430/559; 430/562

[58] Field of Search ..... 430/203, 223, 226, 242, 430/559, 562, 553

[56] References Cited

U.S. PATENT DOCUMENTS

| | | | |
|---|---|---|---|
| 3,227,550 | 1/1966 | Whitmore et al. | 430/226 |
| 3,443,940 | 5/1969 | Bloom et al. | 430/223 |
| 4,076,529 | 2/1978 | Fleckenstein et al. | 430/223 |

OTHER PUBLICATIONS

Kestner et al., "Photographic Elements and Processes", *Research Disclosure,* No. 15157, 11/1976, pp. 68–74.

*Primary Examiner*—Richard L. Schilling
*Attorney, Agent, or Firm*—Sughrue, Mion, Zinn, Macpeak, and Seas

[57] ABSTRACT

A color photographic light-sensitive material is disclosed. The material is comprised of a support having thereon a layer containing at least one kind of dye releasing 2-acylamino-1-naphthol derivative represented by the following general formula (I):

$$R—L—D \qquad (I)$$

wherein R represents a reducing group represented by the following general formula (II):

(II)

wherein the substituents $R_1$–$R_8$ are defined within the application; L represents a connecting group between R and D wherein specific examples of L are defined in the specification; and D represents a dye or a precursor of a dye. The dye releasing 2-acylamino-1-naphthol derivative of the present invention has a high dye releasing efficiency when it is oxidized. The derivative of the invention can release a dye having a good diffusibility and can provide a high dye transfer density and thus it is suitable to use as a coloring material in a color photographic light-sensitive material of diffusion transfer type. A method of forming a color image using the color photographic light-sensitive material is also disclosed.

26 Claims, No Drawings

COLOR PHOTOGRAPHIC LIGHT-SENSITIVE MATERIAL WITH NAPHTHOL REDOX DYE RELEASER

FIELD OF THE INVENTION

The present invention relates to a dye releasing compound which can be used in a color photographic light-sensitive material. More particularly, the present invention relates to a reducing compound which releases a diffusible dye by an oxidation-reduction reaction with a silver halide and/or an organic silver salt compound.

BACKGROUND OF THE INVENTION

Many different processes for forming color images by transferring diffusible dyes are known. For example, in U.S. Pat. No. 3,134,764 a process using a dye developer in which a developing agent of hydroquinone type and a dye are bonded is described. Further, a process in which a diffusible dye is released upon an intramolecular transesterification is described in Japanese Patent Application (OPI) No. 63618/76 (the term "OPI" as used herein refers to a "published unexamined Japanese patent application"), and a process in which a diffusible dye is released upon an intramolecular ring opening and closing reaction of an isooxazolone ring is described in Japanese Patent Application (OPI) No. 111628/74. In these processes, dyes diffuse to an image receiving layer in areas where development is not caused (unexposed areas) and the releasing and diffusion of dyes does not occur in areas where development is caused (exposed areas). However, these processes are disadvantageous because it is difficult to obtain an image having a high S/N ratio since the development and the releasing and diffusion of dyes occur simultaneously. In order to eliminate such a drawback, a process was developed in which a coloring material is previously converted to an oxidized form which does not have a dye releasing ability, the oxidized compound is developed together with a precursor of reducing agent coexistent and the oxidized compound is reduced by the reducing agent which remains without suffering the oxidation to release a diffusible dye. This process is described in Japanese Patent Application (OPI) No. 110827/78. However, this process has a disadvantage in that an image having a high S/N ratio can be obtained only when the development rate and the reduction rate of the coloring material by the reducing agent are strictly adjusted.

In accordance with another known process, a diffusible dye is released in areas where development is caused. In yet another process a diffusible dye is released by a reaction between a coupler having a diffusible dye in a coupling-off group and an oxidation product of a color developing agent. This process is described in British Pat. No. 1,330,524. In another process a diffusible dye is formed by a reaction between a coupler having a diffusion resistant group in a coupling-off group and an oxidation product of a color developing agent. This process is described in U.S. Pat. No. 3,227,550. In these processes using the color developing agent, however, image stains are formed due to oxidative decomposition products of the color developing agent which is a very serious problem.

Furthermore, as reducing dye releasing compounds which are construed as having the same function as the compounds according to the present invention, the compounds represented by the formulae (A) to (L) described below are known.

(A)

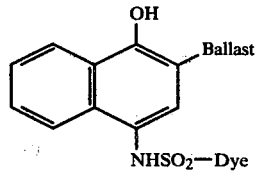

As described in U.S. Pat. Nos. 3,928,312 and 3,993,638.

(B)

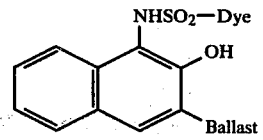

As described in U.S. Pat. No. 4,053,312.

(C)

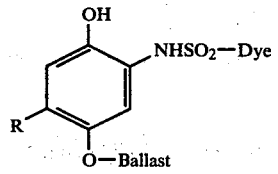

As described in U.S. Pat. No. 4,055,428.

(D)

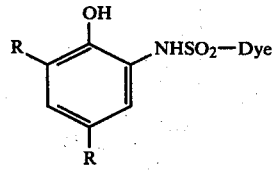

As described in U.S. Pat. No. 4,198,235.

(E)

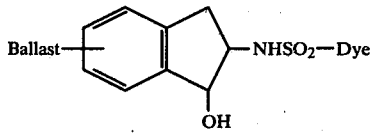

As described in U.S. Pat. No. 4,149,892.

(F)

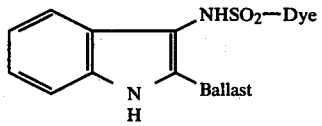

As described in Japanese Patent Application (OPI) No. 104343/76.

(G)

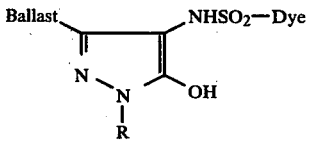

As described in Japanese Patent Application (OPI) No. 104343/76.

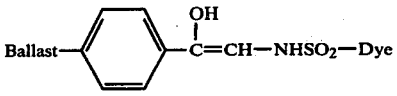

(H)

As described in Japanese Patent Application (OPI) No. 104343/76.

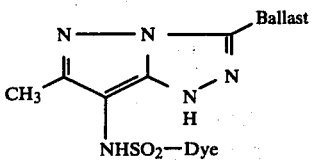

(I)

As described in *Research Disclosure*, No. 17465 (1978).

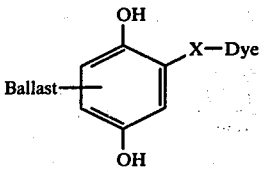

(J)

As described in U.S. Pat. No. 3,725,062.

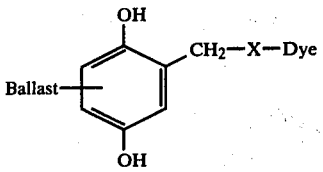

(K)

As described in U.S. Pat. No. 3,728,113.

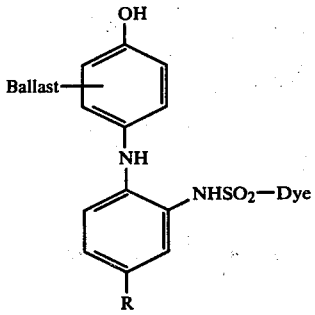

(L)

As described in U.S. Pat. No. 3,443,939.

The compounds represented by the formulae (A) to (I) above are oxidized upon development processing and then release by the action of an alkaline diffusible dye having a sulfamoyl group at an end of the molecule thereof. However, these processes have several drawbacks in that they require an alkaline solution in a high concentration as a developing solution and in that since the dye released has a sulfamoyl group and its diffusibility in a hydrophobic binder is extremely low, it is necessary to use a hydrophilic binder and in addition to use an alkaline solution as a diffusion accelerator in order to obtain images having a high density. Also, the compounds represented by the formulae (J) to (L) have a low efficiency in the dye releasing step after they are oxidized and thus they cannot be applied to practical use.

SUMMARY OF THE INVENTION

The present invention provides a novel dye releasing compound for a color photographic light-sensitive material which eliminates the drawbacks present in hitherto known materials.

Therefore, an object of the present invention is to provide a reducing dye releasing compound capable of providing a high density of dye transferred as a coloring material for diffusion transfer.

Another object of the present invention is to provide a dye releasing compound having a high efficiency in a dye releasing step after it is oxidized.

A further object of the present invention is to provide a dye releasing compound capable of releasing a dye having an excellent diffusibility.

A still further object of the present invention is to provide a dye releasing compound having good durability.

These and other objects of the present invention will become more apparent from the following detailed description and examples.

These objects of the present invention are accomplished with a dye releasing compound represented by the following general formula (I):

$$R—L—D \qquad (I)$$

wherein R represents a reducing group capable of being oxidized with silver halide or an organic silver salt compound; D represents a dye portion for image formation; and L represents a connecting group between R and D.

DETAILED DESCRIPTION OF THE INVENTION

In the general formula (I), the reducing group represented by R is a 2-acylamino-1-naphthol residue and represented by the following general formula (II):

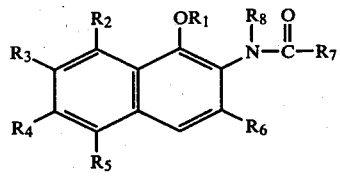

(II)

wherein $R_1$ represents a hydrogen atom or an acyl group having 1 to 12 carbon atoms; $R_2$ to $R_8$, which may be the same or different, each represents a hydrogen atom or a substituent selected from an alkyl group, a cycloalkyl group, an alkenyl group, an aryl group, an alkoxy group, an aryloxy group, an aralkyl group, an acylamino group, an alkylamino group, a dialkylamino group, an arylamino group, a diarylamino group, a halogen atom, an acyloxy group, a hydroxy group, a carboxy group, a cyano group, an acyl group, a carbamoyl group, a substituted carbamoyl group, a sulfamoyl group, a substituted sulfamoyl group, a sulfamoylamino group, a substituted sulfamoylamino group, a ureido group, a substituted ureido group, an alkylsulfonyl group, an arylsulfonyl group, an alkylsulfonylamino group, an arylsulfonylamino group, sulfamoylamino group, a substituted sulfamoylamino group and a nitro group, and the alkyl moiety or the aryl moiety in the above described substituents may be further substituted with an alkoxy group, an aryloxy group, an acyloxy group, a halogen atom, a hydroxy group, a carboxy group, a cyano group, an acyl group, a sulfamoyl group, a substituted sulfamoyl group, a carbamoyl group, a substituted carbamoyl group, an acylamino group, a ureido group, a substituted ureido group, an alkylsulfonyl group, an arylsulfonyl group, an alkylsulfonylamino group or an arylsulfonylamino group.

The groups represented by $R_2$, $R_3$, $R_4$ or $R_5$ may contain up to 12 carbon atoms. On the other hand, the groups represented by $R_6$, $R_7$ or $R_8$ may contain up to 22 carbon atoms and at least one of them should contain not smaller than 8 carbon atoms.

The connecting group represented by L is a divalent residue selected from the group represented by the following formulae:

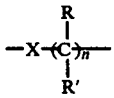
n = 0~3

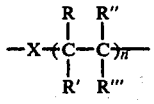
n = 1~2

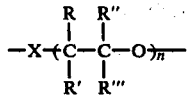
n = 1~2

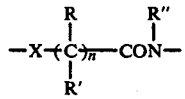
n = 0~3

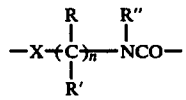
n = 1~3

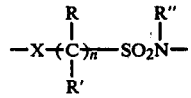
n = 0 ~3

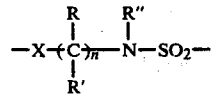
n = 1~3

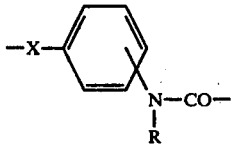

-continued

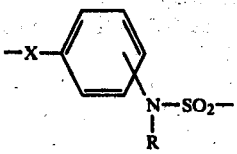

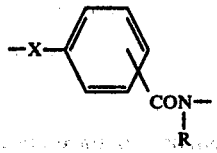

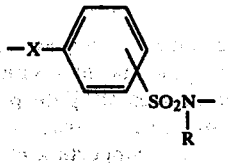

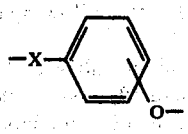

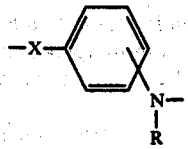

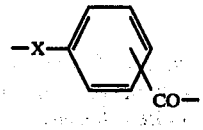

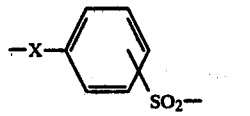

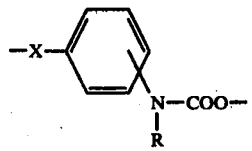

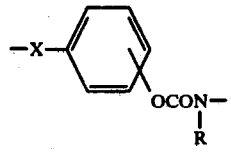

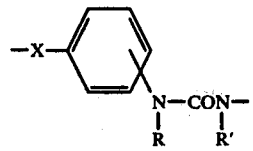

wherein R, R', R'' and R''', which may be the same or different, each represents a hydrogen atom or a substituent selected from a methyl group, an ethyl group, a hydroxymethyl group, a methoxymethyl group, a carboxymethyl group, a cyanomethyl group, a hydroxyethyl group, a methoxyethyl group, a carboxyethyl group and a cyanoethyl group; the benzene ring may be further substituted with an alkyl group, an alkoxy group, a halogen atom or a hydroxy group; and X represents —O—, —S—, $$-\underset{\underset{R}{|}}{N}-,\ -\underset{\underset{COR}{|}}{N}-\ \text{or}\ -\underset{\underset{SO_2R}{|}}{N}-$$

(wherein R has the same meaning as defined above).

The dye portion represented by D represents a dye or a precursor of dye.

It is desirable that the reducing group represented by R has an oxidation-reduction potential to a saturated calomel electrode of 1.2 V or less measuring the polarographic half wave potential using acetonitrile as a solvent and sodium perchlorate as a supporting electrolyte. Further, a preferred group has the following characteristics.

1. It is rapidly oxidized with silver halide or an organic silver salt compound and effectively releases a diffusible dye by the action of a nucleophilic agent.
2. It has a ballast group (which is generally a hydrophobic group containing 10 or more carbon atoms) for immobilizing the dye releasing compound in a binder.
3. It is stable to light, heat and the nucleophilic agent and does not release the diffusible dye until it is oxidized.
4. It is easily synthesized.

In the following, specific examples of preferred reducing group R are set forth, but the present invention is not to be construed as being limited thereto.

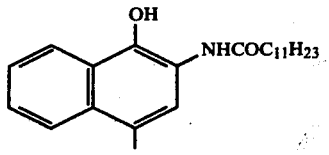

(R-1)

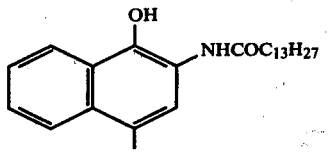

(R-2)

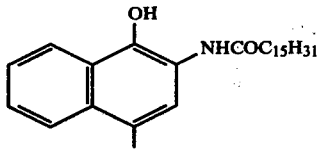

(R-3)

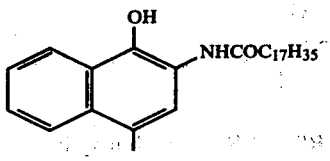

(R-4)

-continued

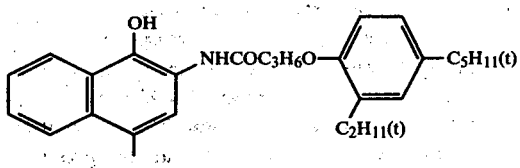

(R-5)

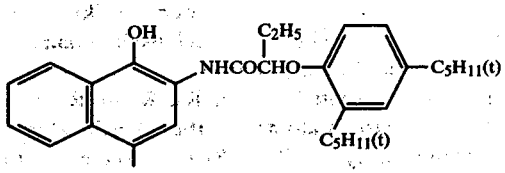

(R-6)

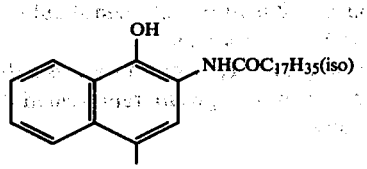

(R-7)

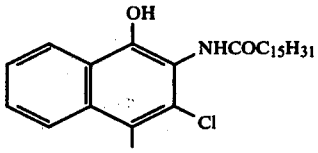

(R-8)

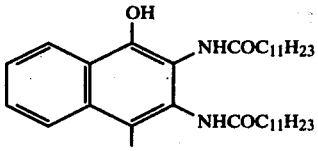

(R-9)

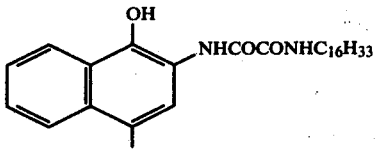

(R-10)

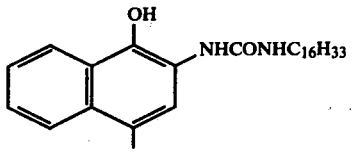

(R-11)

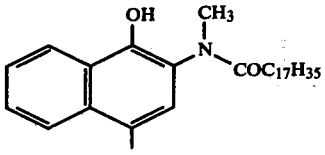

(R-12)

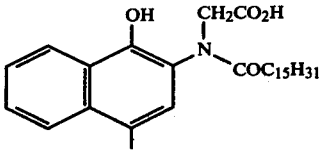

(R-13)

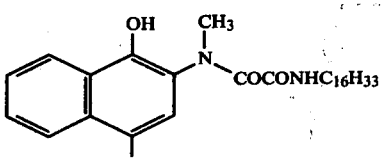

(R-14)

-continued

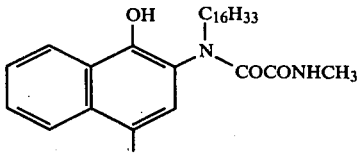

(R-15)

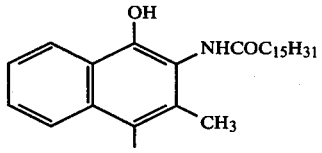

(R-16)

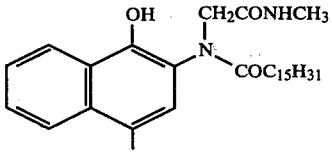

(R-17)

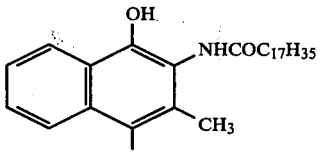

(R-18)

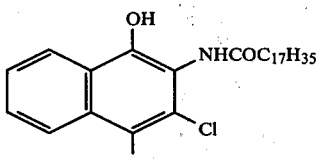

(R-19)

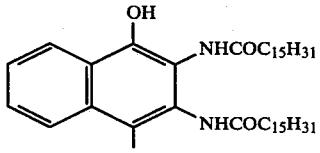

(R-20)

The connecting group represented by L is a chemical bond or a divalent group having 1 to 12 carbon atoms connecting between the above described reducing group R and the dye portion D with a covalent bond, and it also has a great influence upon an oxidation-reduction potential of the reducing group R. Further, the connecting group plays an important part that it acts as a releasing group in the dye releasing step.

It is desirable that the connecting group L does not have a group which hinders diffusion of the dye. Further, groups having a structure sufficiently bulky to hinder the attack of a nucleophilic agent to the carbon atom at the connecting position of R and L (that is, the carbon atom positioned at a p-position to the OH group in R) are not preferred. Specifically, groups connecting with the reducing group R through an oxygen atom and containing a total number of carbon atoms of not more than 12 are preferred and most preferably not more than 8.

Specific examples of preferred connecting groups L are set forth below, but the present invention is not to be construed as being limited thereto.

$-OCH_2CH_2-$ (L-1)

$-OCH_2CH_2CH_2-$ (L-2)

-continued $-OCH_2CONH-$ (L-3)

$-OCH_2CH_2CONH-$ (L-4)

$-\overset{CH_3}{\overset{|}{O}}CH-$ (L-5)

$-\overset{CH_3}{\overset{|}{O}}CH-CH_2-$ (L-6)

$-OCH_2-\overset{CH_3}{\overset{|}{C}}H-$ (L-7)

$-OCH_2-$ (L-8)

$-OCH_2CH_2O-$ (L-9)

$-\overset{CH_3}{\overset{|}{O}}CH-CH_2O-$ (L-10)

$-OCH_2-\overset{CH_3}{\overset{|}{C}}HO-$ (L-11)

$-\overset{CH_3}{\overset{|}{O}}CHCONH-$ (L-12)

$-OCH_2-\overset{CH_3}{\overset{|}{C}}H-CONH-$ (L-13)

$-OCH_2CH_2NHCO-$ (L-14)

$-OCH_2CH_2CH_2NHCO-$ (L-15)

$-OCH_2CH_2CH_2CONH-$ (L-16)

$-OCH_2CH_2CH_2SO_2NH-$ (L-17)

$-OCH_2CH_2NHSO_2-$ (L-18)

$-OCH_2CH_2CH_2NHSO_2-$ (L-19)

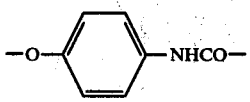

(L-20)

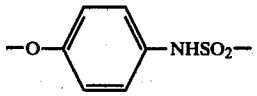

(L-21)

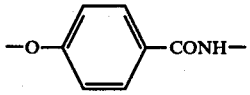

(L-22)

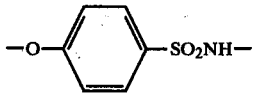

(L-23)

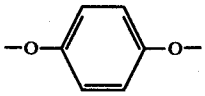

(L-24)

-continued (L-25)

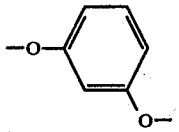

Of these, L-1, L-2, L-3, L-4, L-8, L-9, L-14 and L-18 are preferred.

Examples of dyes which can be used for image forming dye portions include an azo dye, an azomethine dye, an anthraquinone dye, a naphthoquinone dye, a styryl dye, a quinophthalone dye, an indigoid dye, a carbonium ion dye and a phthalocyanine dye, etc. Typical examples of the dyes are set forth below and are classified by hue.

Yellow:

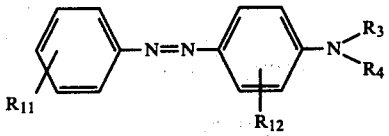

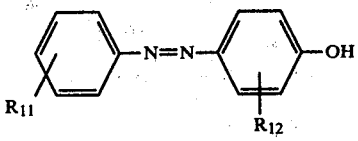

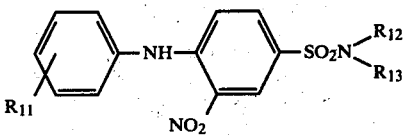

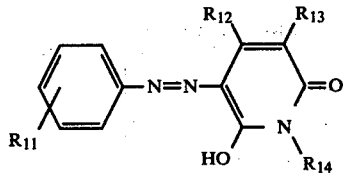

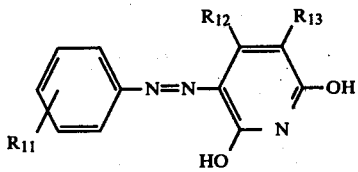

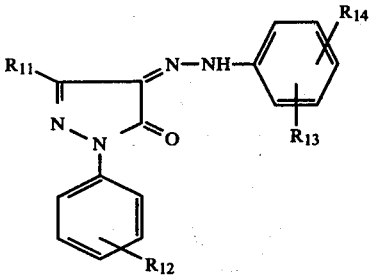

-continued

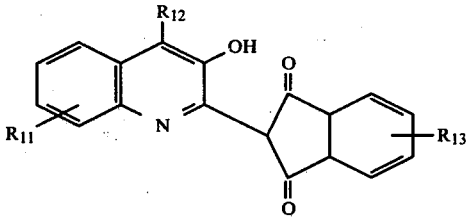

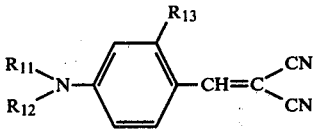

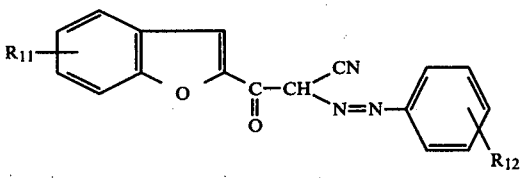

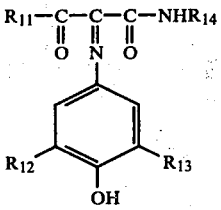

Magenta:

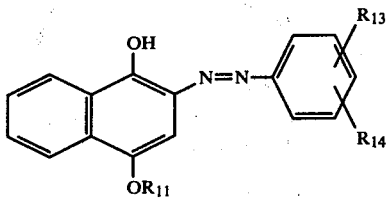

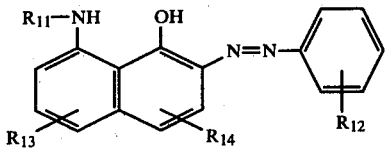

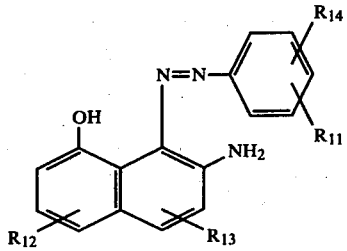

-continued
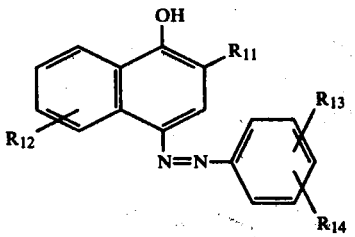
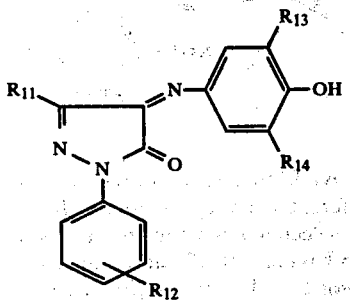
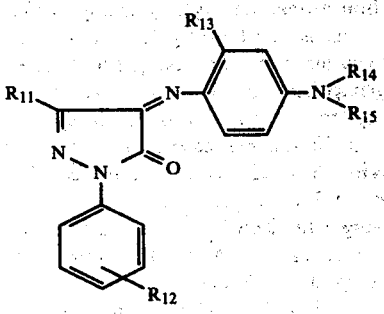
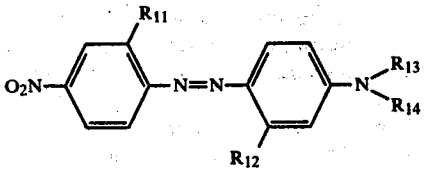
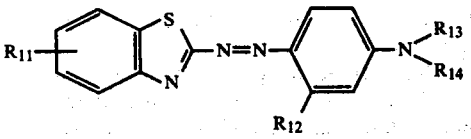
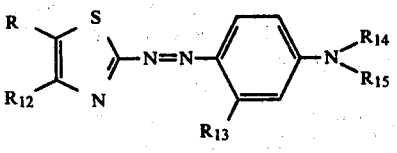
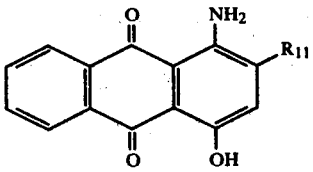
-continued
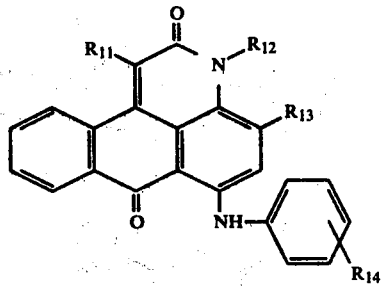
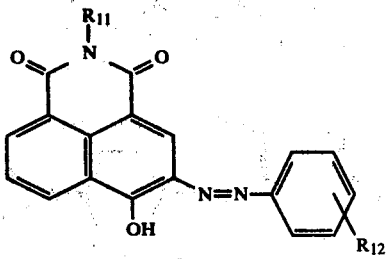
Cyan:
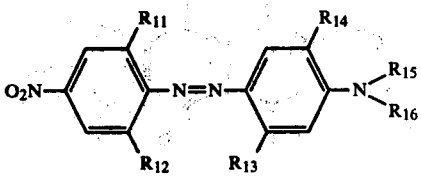
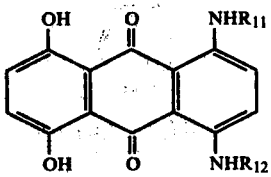
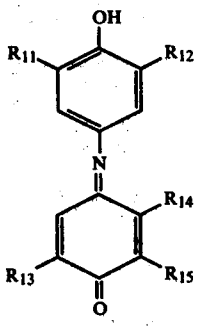
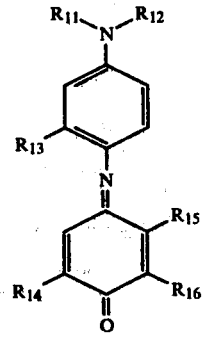

-continued

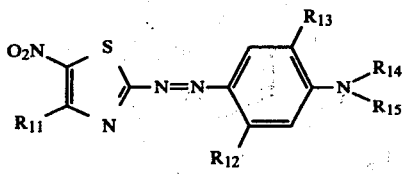

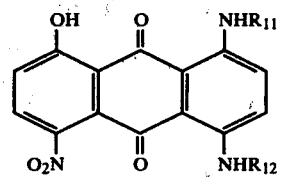

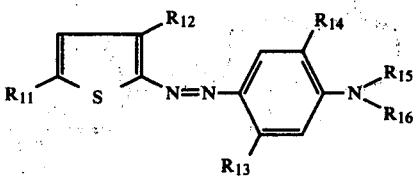

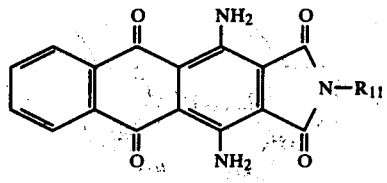

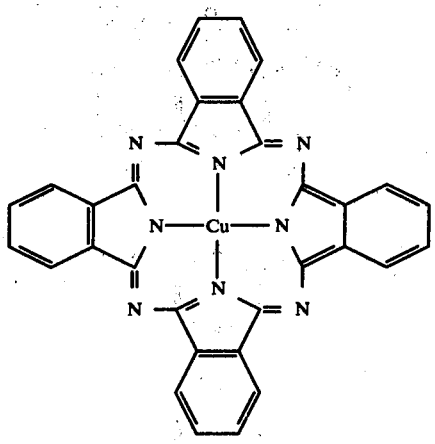

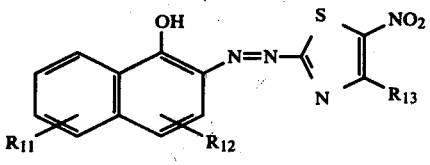

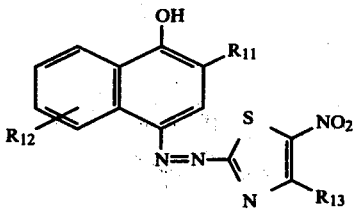

-continued

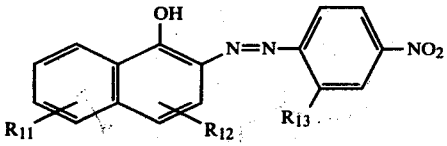

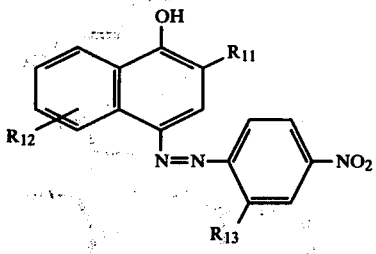

In the above formulae, $R_{11}$ to $R_{16}$, which may be the same or different, each represents a hydrogen atom or a substituent selected from the group consisting of an alkyl group having 1 to 12 carbon atoms, a cycloalkyl group having 5 to 12 carbon atoms, an aralkyl group having 7 to 12 carbon atoms, an alkoxy group having 1 to 12 carbon atoms, an aryloxy group having 6 to 12 carbon atoms, an aryl group having 6 to 12 carbon atoms, an acylamino group having 1 to 22 carbon atoms, an acyl group having 1 to 12 carbon atoms, a cyano group, a hydroxy group, an alkylsulfonylamino group having 1 to 12 carbon atoms, an arylsulfonylamino group having 6 to 12 carbon atoms, an alkylsulfonyl group having 1 to 12 carbon atoms, a hydroxyalkyl group having 1 to 12 carbon atoms, a cyanoalkyl group having 2 to 12 carbon atoms, an alkoxycarbonylalkyl group having 3 to 12 carbon atoms, an alkoxyalkyl group having 2 to 12 carbon atoms, an aryloxyalkyl group having 7 to 12 carbon atoms, a nitro group, a halogen atom, a sulfamoyl group, an N-substituted sulfamoyl group having 1 to 12 carbon atoms, a carbamoyl group, an N-substituted carbamoyl group having 1 to 12 carbon atoms, an acyloxyalkyl group having 2 to 12 carbon atoms, an amino group, a substituted amino group having 1 to 12 carbon atoms, an alkylthio group having 1 to 12 carbon atoms and an arylthio group having 6 to 12 carbon atoms.

Characteristics required for the image forming dyes are as follows.

(1) It has sufficiently good diffusibility that it effectively diffuses into an image receiving layer and it can tint in a high optical density an image receiving sheet.

(2) It has a hue suitable for color reproduction.

(3) It has a large molecular extinction coefficient.

(4) It is stable to light, heat and other additives included in the system.

(5) It is easily synthesized.

Specific examples of the preferred image forming dyes which satisfy the above described requirements are set forth below, but the present invention is not to be construed as being limited thereto.

Yellow Dye 1

-continued
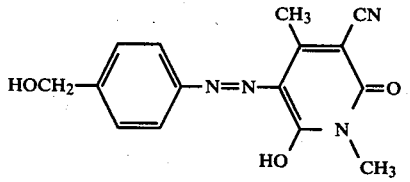
Yellow Dye 2
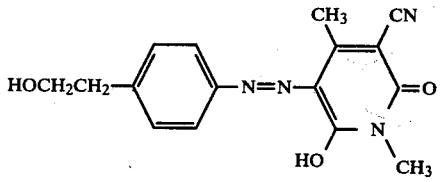
Yellow Dye 3
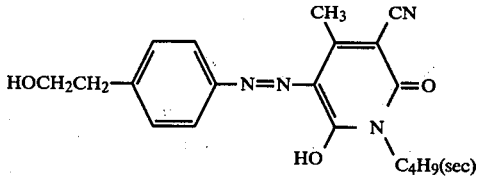
Yellow Dye 4
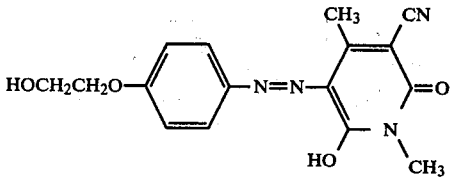
Yellow Dye 5
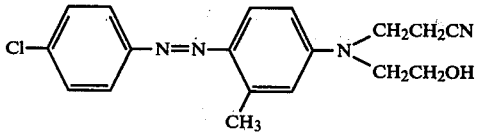
Yellow Dye 6
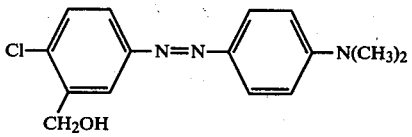
Yellow Dye 7
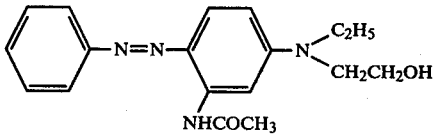
Yellow Dye 8
-continued
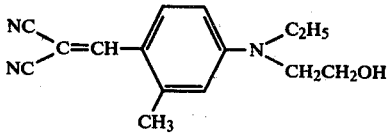
Yellow Dye 9
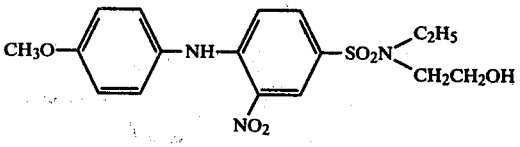
Yellow Dye 10
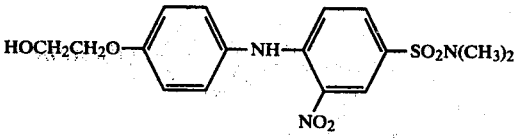
Yellow Dye 11
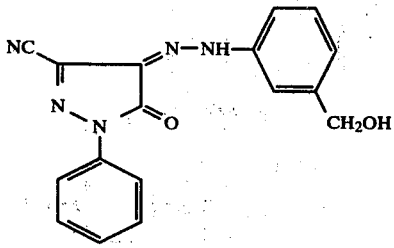
Yellow Dye 12
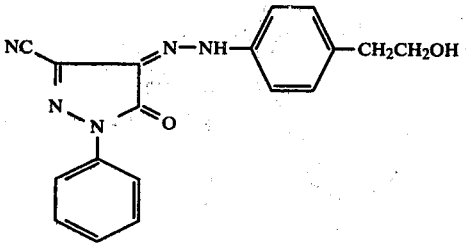
Yellow Dye 13
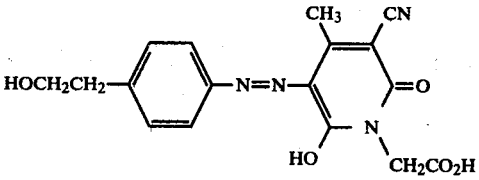
Yellow Dye 14
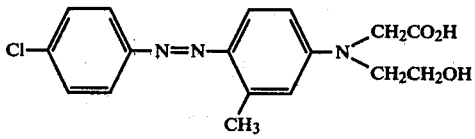
Yellow Dye 15

-continued
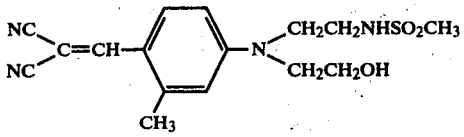
Yellow Dye 16
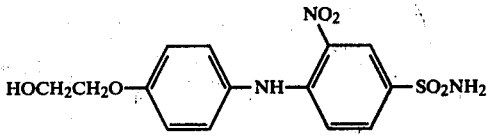
Yellow Dye 17
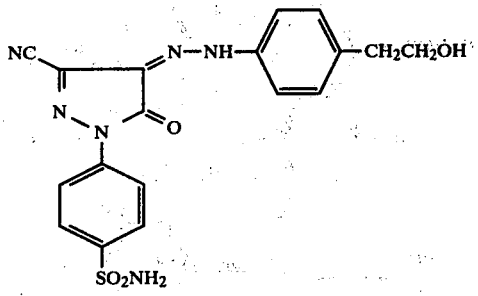
Magenta Dye 1
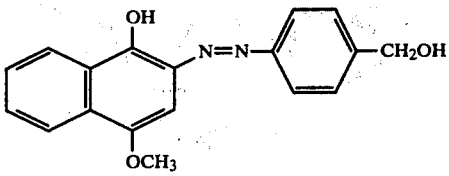
Magenta Dye 2
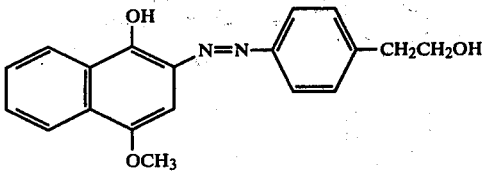
Magenta Dye 3
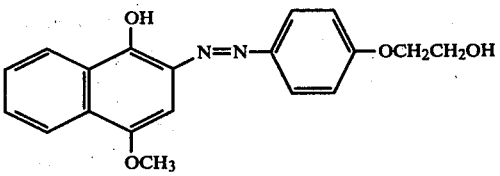
Magenta Dye 4
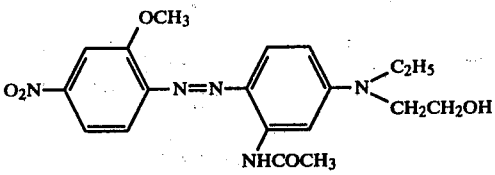
-continued
Magenta Dye 5
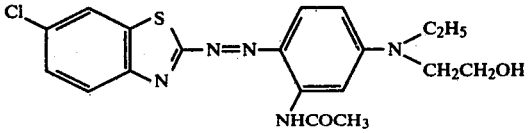
Magenta Dye 6
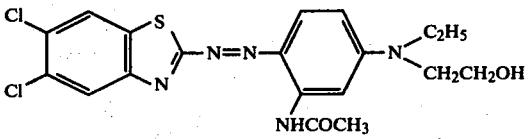
Magenta Dye 7
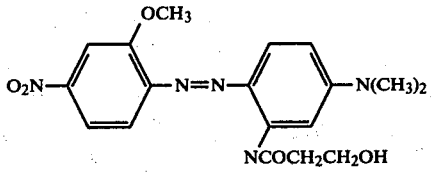
Magenta Dye 8
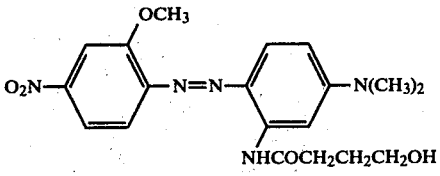
Magenta Dye 9
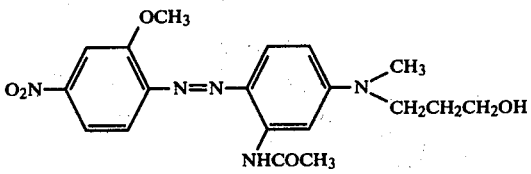
Magenta Dye 10
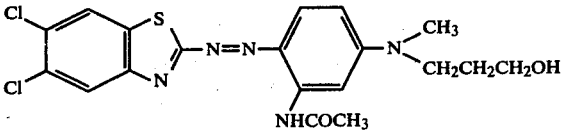
Magenta Dye 11
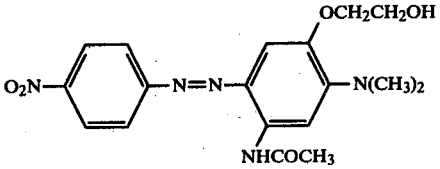
Magenta Dye 12

-continued
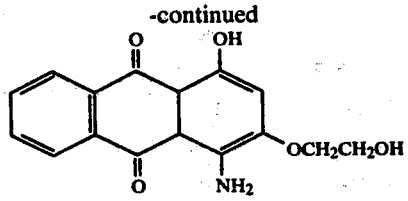
Magenta Dye 13
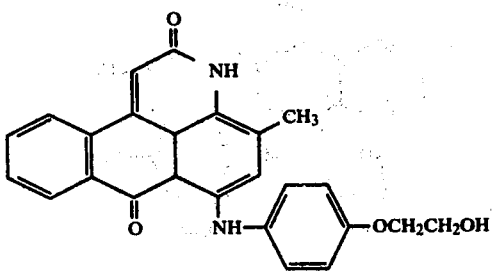
Magenta Dye 14
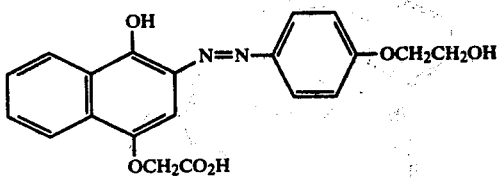
Magenta Dye 15
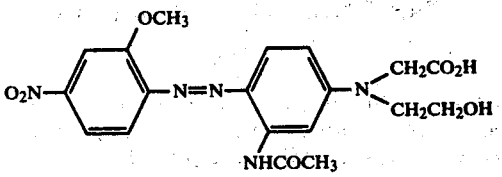
Magenta Dye 16
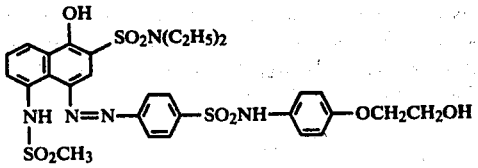
Magenta Dye 17
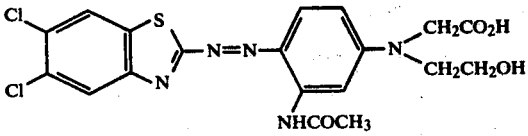
Magenta Dye 18
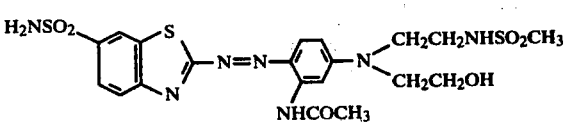
Cyan Dye 1
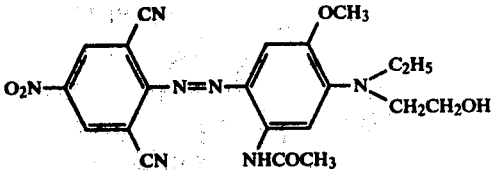
Cyan Dye 2
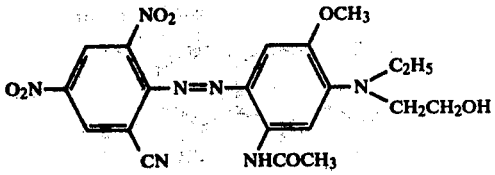
Cyan Dye 3
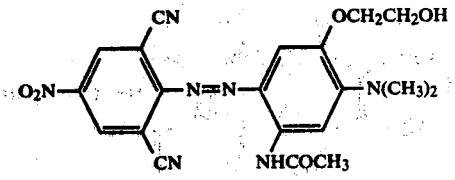
Cyan Dye 4
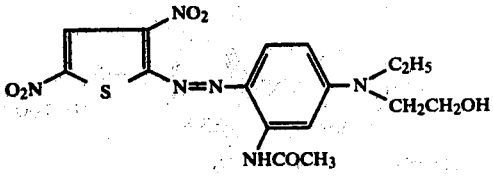
Cyan Dye 5
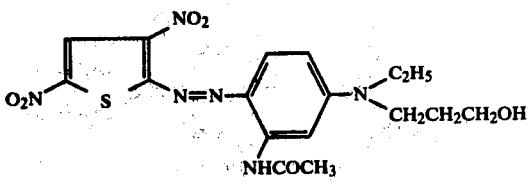
Cyan Dye 6
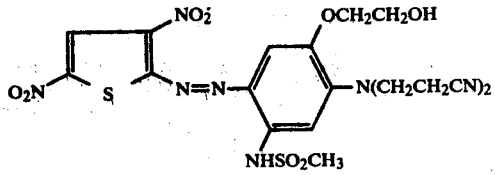
Cyan Dye 7
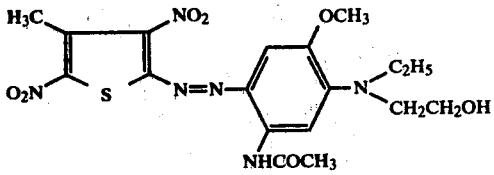
Cyan Dye 8

-continued

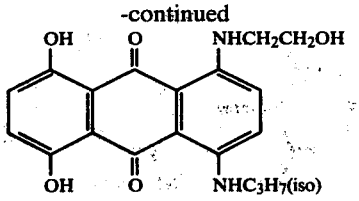

Cyan Dye 9

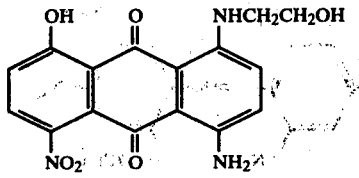

Cyan Dye 10

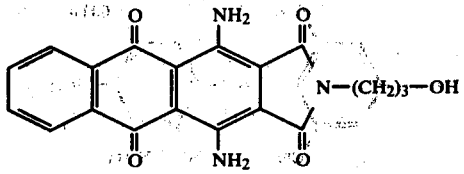

Cyan Dye 11

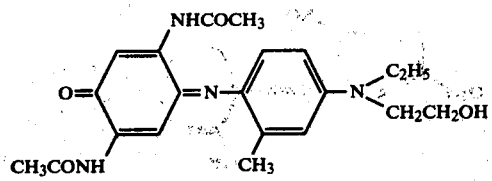

Cyan Dye 12

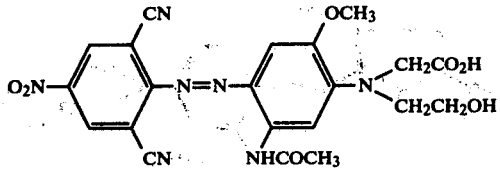

Cyan Dye 13

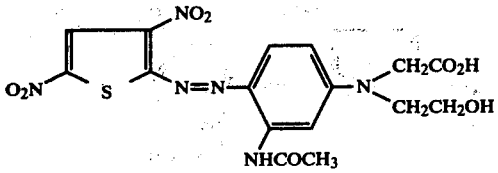

Cyan Dye 14

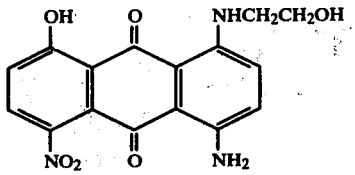

Cyan Dye 15

-continued

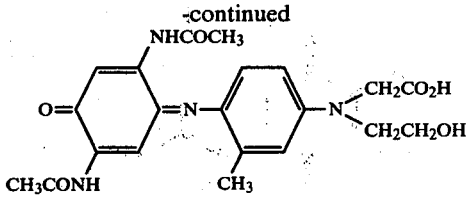

Cyan Dye 16

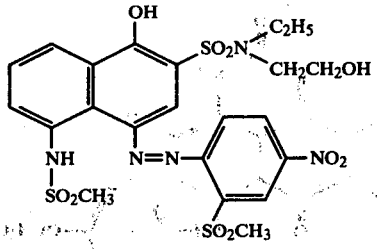

Cyan Dye 17

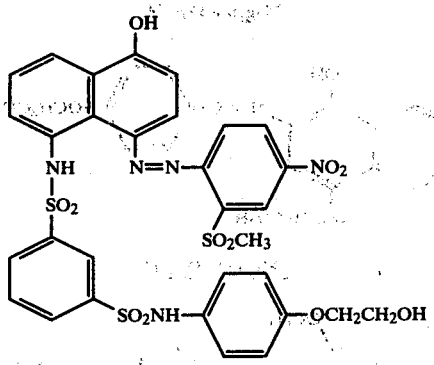

The image forming dyes may be used in a form of a dye precursor (for example, a leuco compound, a temporarily short-wave-shifted compound, etc.).

It is believed that the dye releasing compound according to the present invention causes an oxidation reduction reaction with silver halide or an organic silver salt compound during development and then releases a diffusible dye by the action of a nucleophilic agent as a dye releasing accelerator. These processes can be illustrated as follows.

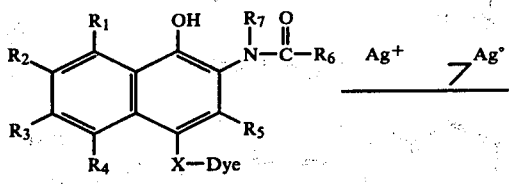

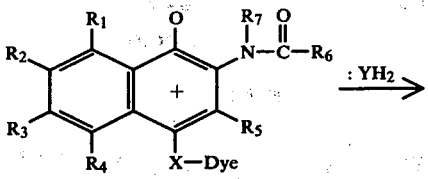

-continued

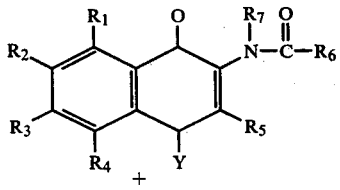

Dye-XH (Y: O, N—R)

The above described mechanism in which a dye is released is completely different from the dye releasing mechanism of Compounds (A) to (L) described before. It has heretofore not been known at all that the 2-acylamino-1-naphthol derivative has sufficient reducing power with respect to a silver ion and an oxidation product thereof effectively releases a dye by the action of a nucleophilic agent. It is also a noticeable fact that the excellent properties which the dye releasing compound according to the present invention possesses depends on the action of the acylamino group present at the ortho position to the phenolic hydroxy group. More specifically, it is known that the o-sulfonamidophenol derivatives also have a reducing power with respect to a silver ion, but an oxidation product thereof is cleaved by the action of a nucleophilic agent and a sulfonamido group is released. On the contrary, a subsidiary reaction in which an acylamino group is released from the oxidation product of the compound according to the present invention scarcely occurs and the dye releasing is dominant. This is believed to be why the high dye releasing efficiency is obtained.

Further, according to the preferred embodiment of the present invention, the dye releasing compound is an oxygen-releasing type compuund and a dye released therefrom has a hydroxy group at the end of its molecule. The dyes having a hydroxy group at the end of their molecules are excellent in transferability in comparison with dyes having a terminal sulfamoyl group which are released from the above described Compounds (A) to (L). This tendency is particularly remarkable when a hydrophobic binder is used or when a dye is tinted by heating to a polymer film and a great difference is observed in transferability. In consequence, when the dye releasing compounds according to the present invention are employed, a high dye transfer density can be obtained using not only a hydrophilic binder but also a hydrophobic binder.

Furthermore, they have a special practical value that a nucleophilic agent which is used as a dye releasing accelerator can be selected from a wide range of compounds such as water, amines, guanidines, amidines, hydrazines, ureas and precursors thereof, etc., in addition to alkali hydroxides.

Moreover, the dye releasing compounds according to the present invention are essentially different from colored couplers including a diffusible dye of an oxygen releasing type as a releasing group as described, for example, in British Pat. No. 1,330,524 since the dye releasing compounds themselves have a reducing property with respect to a silver ion. Colored couplers per se do not have the reducing property with respect to a silver ion and they relate a diffusible dye only when then react with an oxidation product of a developing agent.

It is preferred that a dye releasing compound capable of releasing a diffusible dye is a compound which does not tint an image receiving sheet and only a dye released therefrom by an action of a dye releasing accelerator after it is oxidized tints in a high optical density the image receiving sheet. Therefore, according to the preferred embodiment, the dye releasing compounds are those in which the reducing group R has a ballast group for preventing the tinting of the image receiving sheet and the dye portion D does not contain a group which hinders the tinting of the image receiving sheet.

Specific examples of preferred dye releasing compounds are set forth below, but the present invention is not to be construed as being limited thereto.

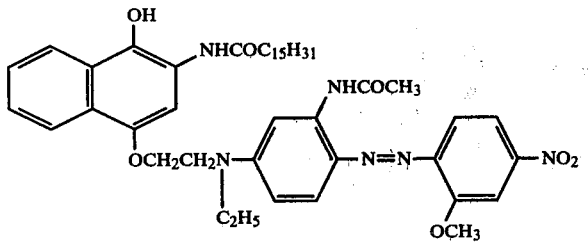

(1)

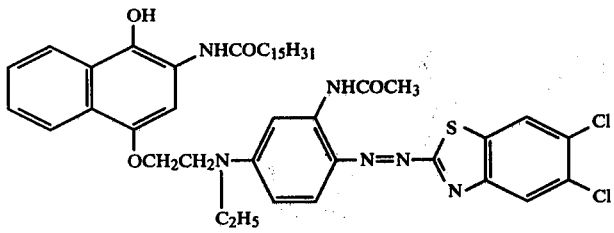

(2)

-continued
(3)
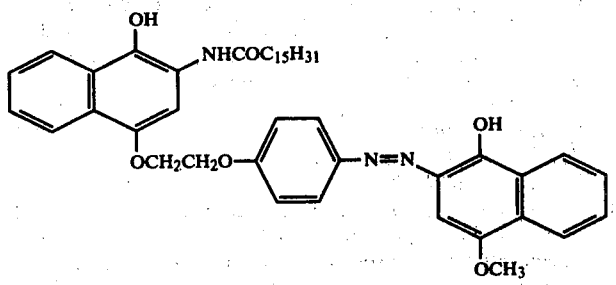
(4)
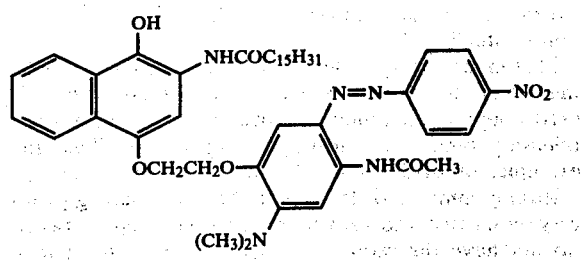
(5)
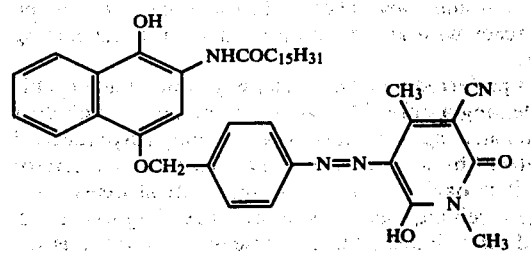
(6)
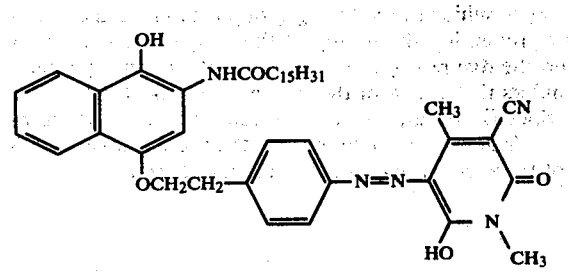
(7)
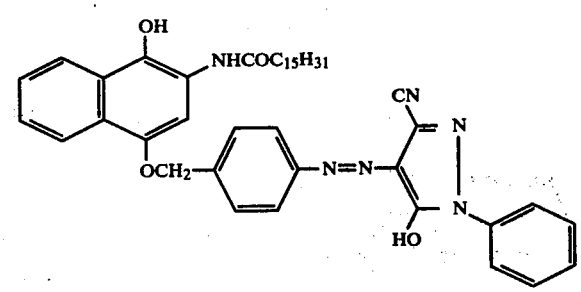
(8)
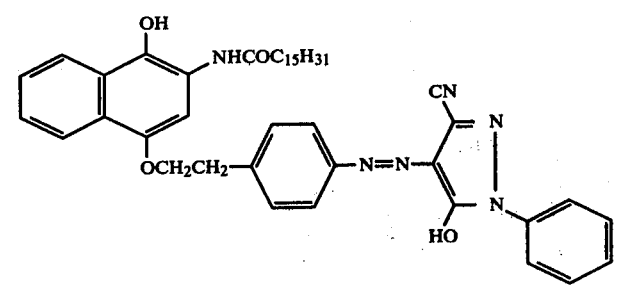

-continued
(9)
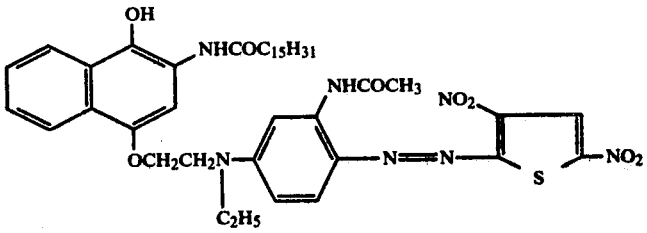
(10)
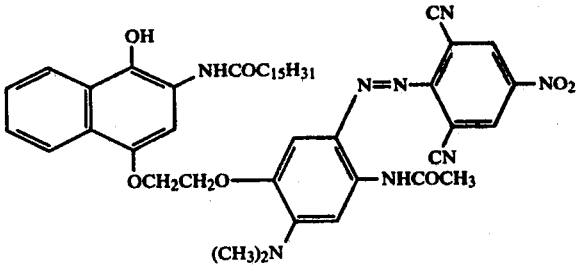
(11)
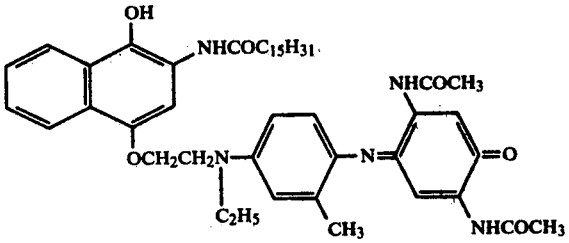
(12)
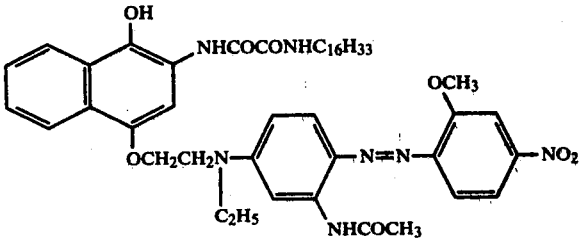
(13)
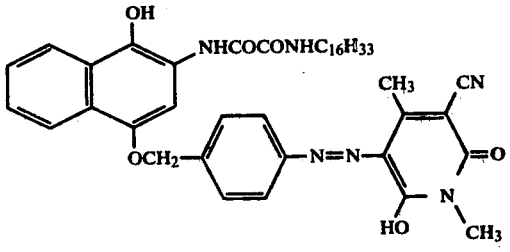
(14)
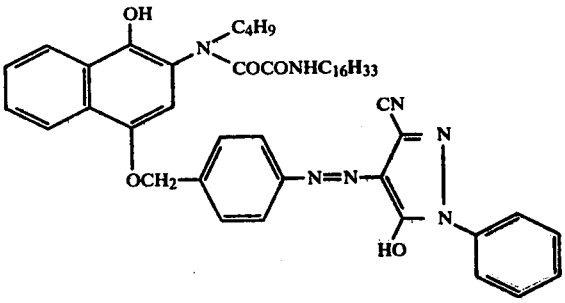

-continued
(15)
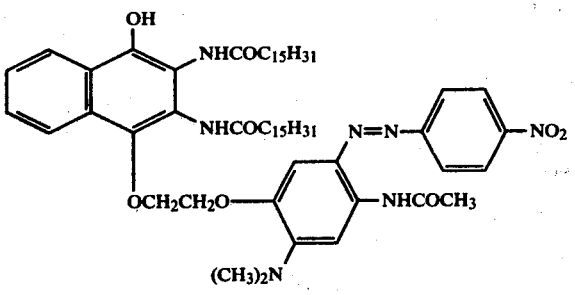
(16)
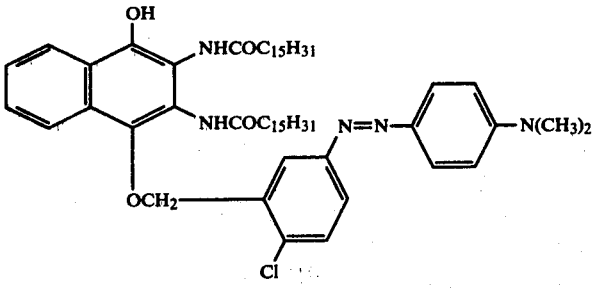
(17)
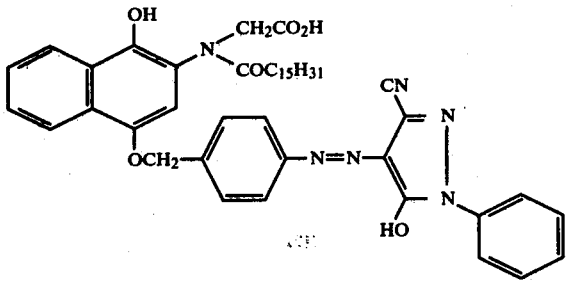
(18)
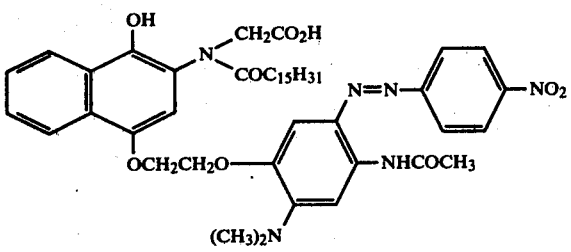
(19)
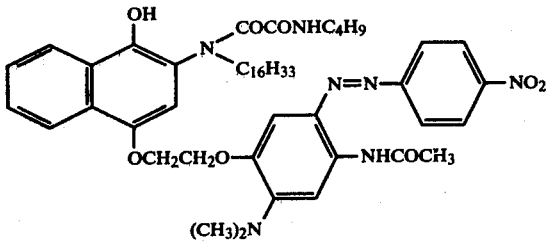
(20)
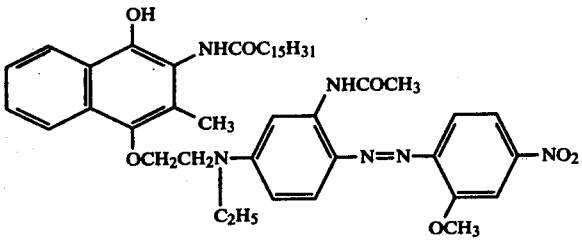

-continued
(21)
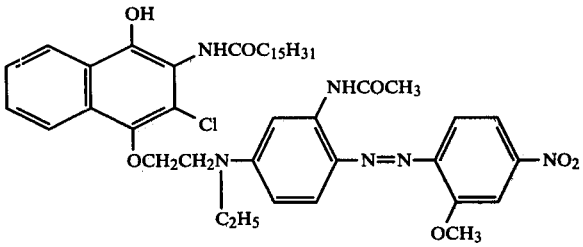
(22)
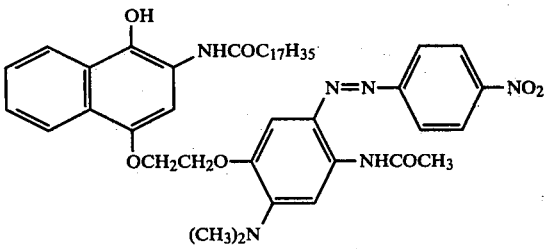
(23)
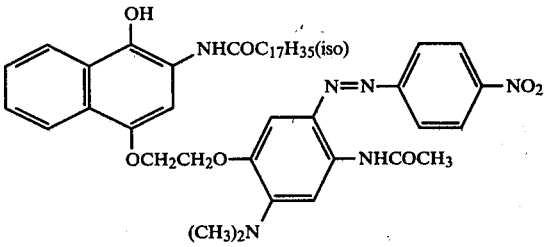
(24)
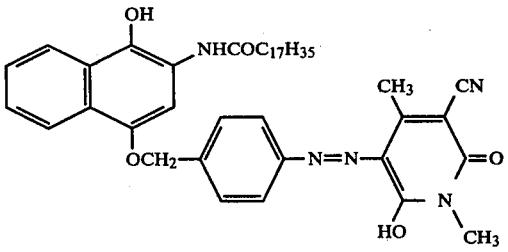
(25)
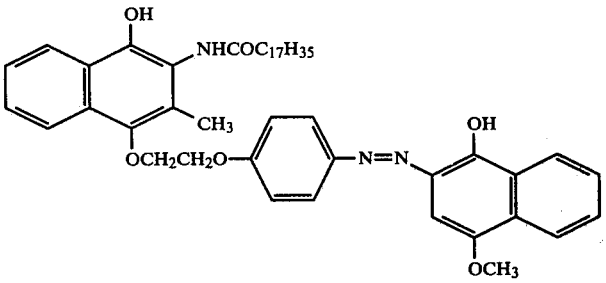
(26)
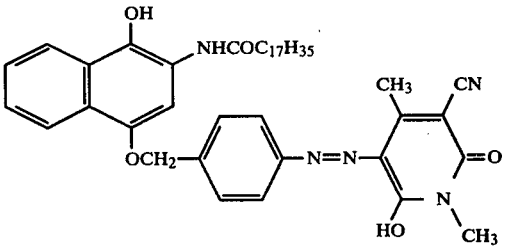

-continued
(27)
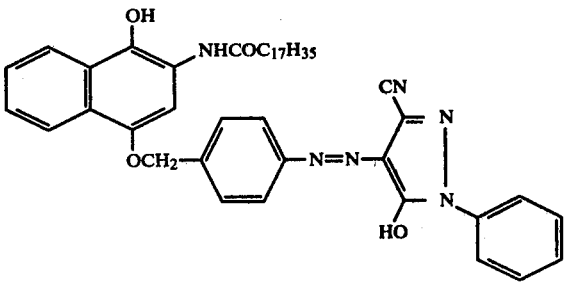
(28)
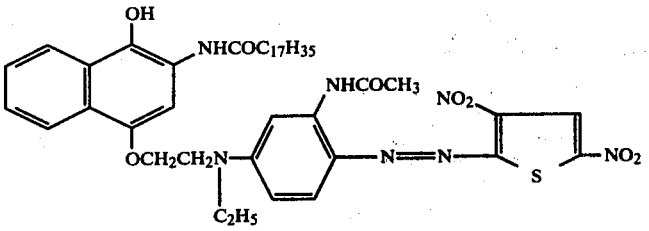
(29)
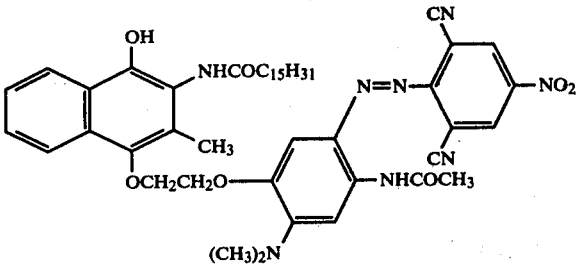
(30)
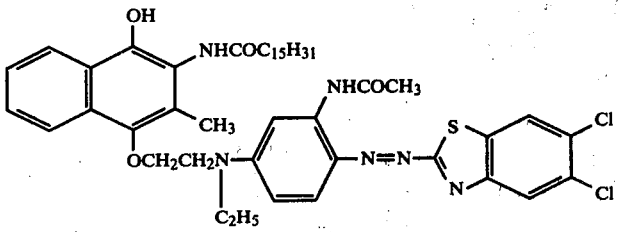
(31)
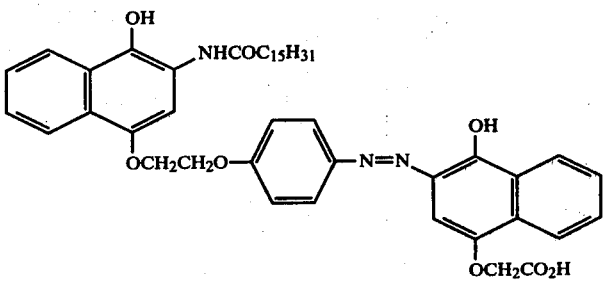
(32)
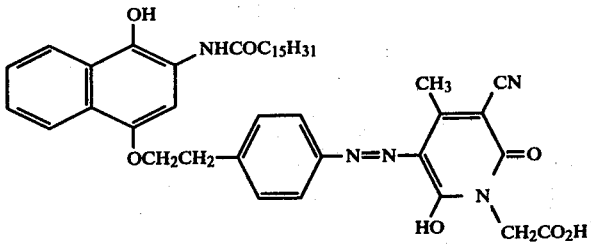

-continued (33)

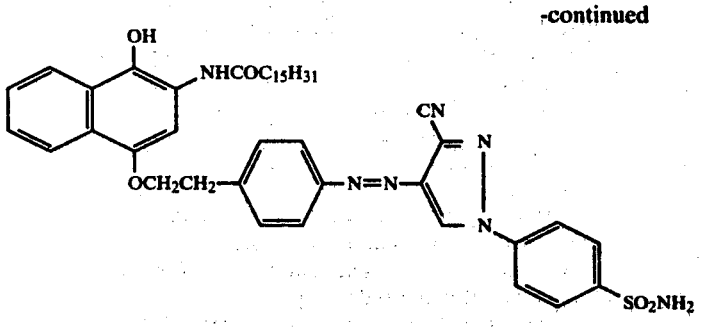

(34)

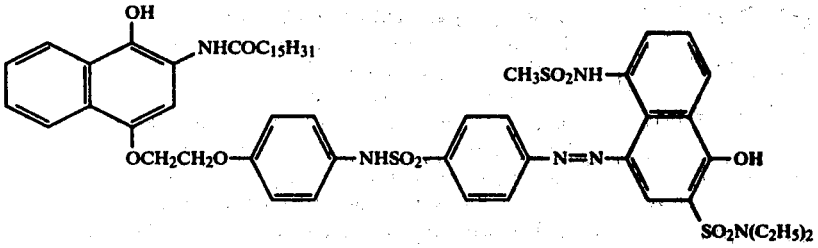

(35)

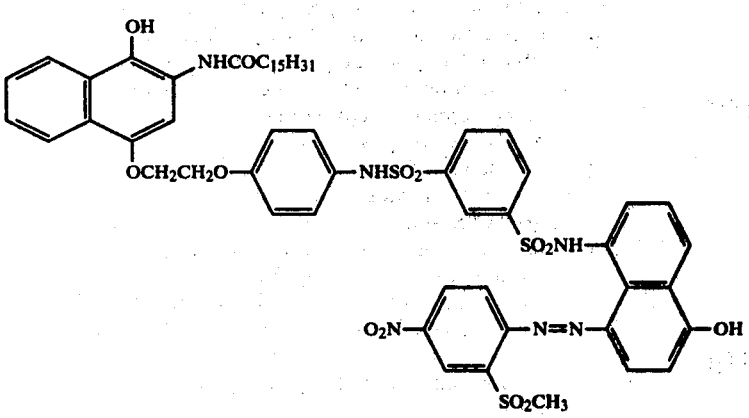

The synthesis method of the dye releasing compounds according to the present invention is described below. The dye releasing compound according to the present invention is represented by the following general formula:

R—L—D wherein R represents a reducing group; L represents a connecting group; and D represents a dye portion for image formation, and can be generally synthesized according to the following scheme:

$$R{-}H + X{-}L{-}D \xrightarrow[-HX]{Base} R{-}L{-}D$$

More specifically, it is mainly classified into the following three schemes.

Scheme A:

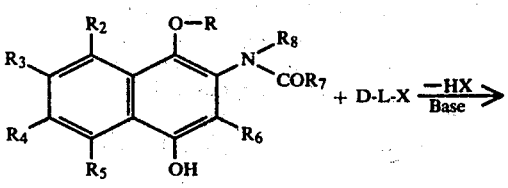

-continued

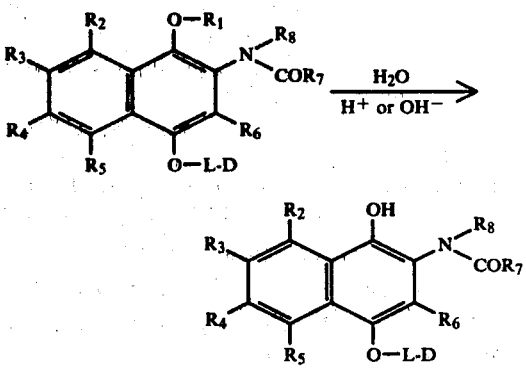

Scheme B:

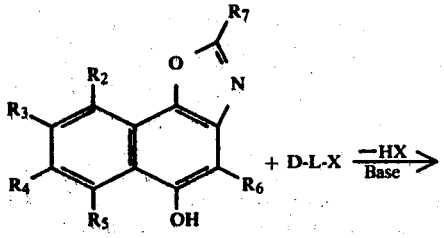

-continued

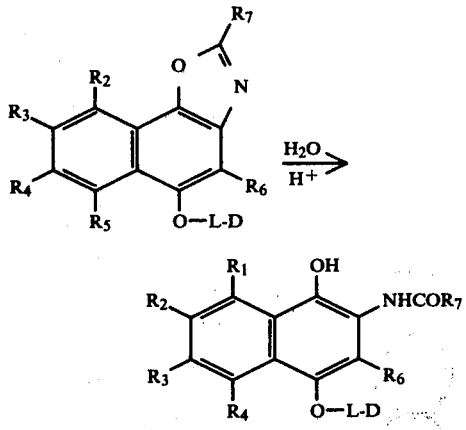

Scheme C:

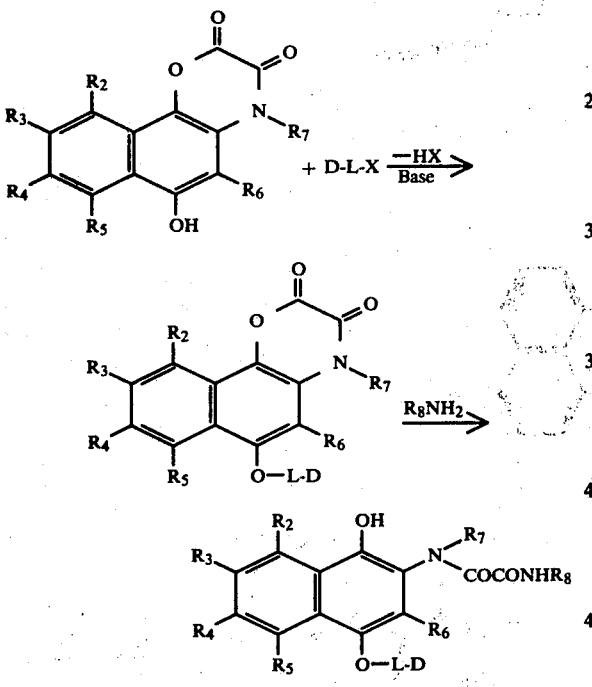

Specific examples for the synthesis of the dye releasing compounds are set forth below, but the present invention is not to be construed as being limited thereto.

SYNTHESIS EXAMPLE 1

Synthesis of Dye Releasing Compound (1)

1-a: Synthesis of 2-hexadecanoylamino-1,4-naphthoquinone [1-a]

A mixture composed of 173 g of 2-amino-1,4-naphthoquinone, 412 g of palmitoyl chloride and 1 liter of acetonitrile was refluxed by heating for 2 hours with stirring. After being allowed to cool, the light yellow colored crystals thus deposited were collected by filtration, washed with acetonitrile and dried. Yield: 405 g.

1-b: Synthesis of 5-hydroxy-2-pentadecylnaphth[1,2-a]-oxazole [1-b]

A mixture composed of 411 g of Compound [1-a], 250 g of stannous chloride dihydrate and 3 liters of toluene was stirred at a temperature range between 70° C. and 80° C. for 1 hour. To the mixture was added little by little 400 g of p-toluenesulfonic acid monohydrate and the temperature was gradually raised to remove water by azeotropic distillation. After the completion of the distillation of water, the mixture was further heated at 110° C. for 1 hour with stirring. Then, the toluene solution was subjected to decantation, to the residue was further added 2 liters of toluene and extracted with heating. The toluene solutions were mixed, washed with an aqueous solution of sodium hydroxide and then with an aqueous solution of sodium chloride and dried with anhydrous magnesium sulfate. The toluene was distilled off under reduced pressure and the residue was recrystallized from n-hexane to obtain 220 g of Compound [1-b] as light brown colored crystals.

1-c: Synthesis of 5-benzenesulfonyloxy-2-pentadecylnaphth[1,2-a]oxazole [1-c]

To a mixture composed of 195 g of Compound [1-b] and 1 liter of pyridine was added dropwise 95 ml of benzenesulfonyl chloride at room temperature. After stirring at a temperature range between 55° C. and 60° C. for 5 hours, the reaction mixture was allowed to cool and poured into an excess amount of cold diluted hydrochloric acid. The precipitate thus deposited was collected by filtration and recrystallized from n-hexane to obtain 210 g of Compound [1-c] as white crystals.

1-d: Synthesis of 4-benzenesulfonyloxy-2-hexadecanoylamino-1-naphthol [1-d]

A mixture composed of 84 g of Compound [1-c], 42 g of p-toluenesulfonic acid, 1 liter of methyl Cellosolve and 170 ml of water was refluxed by heating for 1.5 hours. After allowing to cool, the reaction solution was poured into 2 liters of ice water and the precipitate thus deposited was collected by filtration. The crude product was recrystallized from n-hexane to obtain 62 g of Compound [1-d] as light brown colored crystals.

1-e: Synthesis of 4-benzenesulfonyloxy-2-hexadecanoylamino-1-methoxyethoxymethoxynaphthalene [1-e]

To a mixture composed of 82 g of Compound [1-d], 54 g of methoxyethoxymethyl chloride, 270 ml of acetonitrile and 100 ml of tetrahydrofuran was added dropwise 58 g of diisopropylethylamine under cooling with ice. After stirring for 30 minutes at room temperature, the mixture was filtered and the residue was washed with tetrahydrofuran. The filtrate and the wash liquid were mixed and concentrated under reduced pressure to about a half volume of the original. The residue was poured into 600 ml of ice water and the precipitate thus deposited was collected by filtration and washed with water to obtain 56.5 g of Compound [1-e].

1-f: Synthesis of 3-hexadecanoylamino-4-methoxyethoxymethoxy-1-naphthol [1-f]

A mixture composed of 56.5 g of Compound [1-e], 300 ml of a 20% aqueous solution of sodium hydroxide, 50 g of tetrabutylammonium bromide and 100 ml of benzene was refluxed by heating for 10 hours with vigorous stirring. After allowing to cool, to the mixture was added 300 ml of ethyl acetate. The organic layer was separated, washed with diluted acetic acid and then with water and dried with anhydrous magnesium sulfate. The solvent was distilled off under reduced pressure and the residue was purified by a silica gel chromatography to obtain 26 g of Compound [1-f].

1-g: Synthesis of N-ethyl-N-hydroxyethyl-3-acetylamino-4-(2-methoxy-4-nitrophenylazo)aniline [1-g]

8.3 g of 2-methoxy-4-nitroaniline was diazotized in a conventional manner using 4 g of sodium nitrite. The diazotized solution thus obtained was added to a mixture composed of 12 g of 3-acetylamino-N-ethyl-N-hydroxyethylaniline, 20 g of sodium acetate, 70 ml of methyl Cellosolve and 50 ml of water at a temperature of not more than 10° C. The mixture was stirred at a temperature range between 10° C. and 15° C. for 30 minutes, the crystals thus deposited were collected by filtration and washed with water. The crude product was recrystallized from acetonitrile to obtain 16 g of Compound [1-g].

1-h: Synthesis of N-ethyl-N-benzenesulfonyloxyethyl-3-acetylamino-4-(2-methoxy-4-nitrophenylazo) aniline [1-h]

To a mixture composed of 16 g of Compound [1-g] and 70 ml of pyridine was added dropwise 13 g of benzenesulfonyl chloride under cooling with ice. The mixture was stirred at a temperature range between 10° C. and 15° C. for 2 hours and then the reaction solution was poured into cold diluted hydrochloric acid. The precipitate thus deposited was collected by filtration, washed with water and recrystallized from acetonitrile to obtain 9.5 g of Compound [1-h].

1-i: Synthesis of N-ethyl-N-(3-hexadecanoylamino-4-methoxyethoxymethoxy-1-naphthyloxyethyl)-3-acetylamino-4-(2-methoxy-4-nitrophenylazo)aniline [1-i]

5 g of Compound [1-f] was dissolved in 30 ml of dried diglime (3) and to the solution was added 0.48 g of a 50% oily sodium hydride. Then, 4.2 g of Compound [1-h] was added and the mixture was stirred at 80° C. for 5 hours. After allowing to cool, 100 ml of water was added to the mixture and extracted with ethyl acetate. The extract was washed with water, dried with anhydrous magnesium sulfate and the ethyl acetate was distilled off under reduced pressure. The residue was purified by a silica gel chromatography to obtain 4.8 g of Compound [1-i].

1-j: Synthesis of Dye Releasing Compound (1)

3 g of Compound [1-i] was dissolved in 30 ml of tetrahydrofuran, to the solution was added 1 ml of 1 N hydrochloric acid and the mixture was stirred at room temperature for 1 hour. The reaction solution was poured into cold water, the precipitate thus deposited was collected by filtration and recrystallized form a solvent mixture of hexane and ethyl acetate to obtain 2.1 g of Dye Releasing Compound (1), m.p. 146° to 148° C.

SYNTHESIS EXAMPLE 2

Synthesis of Dye Releasing Compound (5)

2-a: Synthesis of 3-cyano-1,4-dimethyl-6-hydroxy-5-(4-hydroxymethylphenylazo)-2-pyridone [2-a]

12.3 g of p-aminobenzyl alcohol was diazotized in a conventional manner using 30 ml of hydrochloric acid and 7 g of sodium nitrite. The diazotized solution thus obtained was added to a mixture composed of 16.4 g of 3-cyano-1,4-dimethyl-6-hydroxy-2-pyridone, 4 g of sodium hydroxide, 50 g of sodium acetate and 300 ml of water at a temperature range between 0° C. and 5° C. The mixture was stirred at a temperatue range between 5° C. and 10° C. for 30 minutes, the orange yellow colored precipitate thus deposited was collected by filtration and washed with water to obtain 28.5 g of Compound [2-a].

2-b: Synthesis of 3-cyano-1,4-dimethyl-6-hydroxy-5-(4-benzenesulfonyloxymethylphenylazo)-2-pyridone [2-b]

14.9 g of Compound [2-a] was benzenesulfonylated in the same manner as described in Step 1-h using 12 g of benzenesulfonyl chloride in 50 ml of pyridine and 20 ml of dimethylacetamide to obtain 10.8 g of Compound [2-b].

2-c: Synthesis of 3-cyano-1,4-dimethyl-6-hydroxy-5-[4-(3-hexadecanoylamino-4-methoxyethoxymethoxy-1-naphthyloxymethyl)phenylazo]-2-pyridone [2-c]

5 g of Compound [1-f] was dissolved in 30 ml of dried diglime and to the solution was added 0.48 g of a 50% oily sodium hydride. Then, 4.4 g of Compound [2-b] was added and the mixture was stirred at 80° C. for 1.5 hours. By subjecting the same treatment as described in Step [1-i], 5.5 g of Compound [2-c] was obtained.

2-d: Synthesis of Dye Releasing Compound (5)

3 g of Compound [2-c] was dissolved in 30 ml of tetrahydrofuran and to the solution was added 1 ml of 1 N hydrochloric acid and the mixture was stirred at room temperature for 30 minutes, the reaction solution was poured into cold water, the orange yellow colored precipitate thus deposited was collected by filtration and recrystallized from a solvent mixture of hexane and ethyl acetate to obtain 2.2 g of Dye Releasing Compound (5). m.p. 132° to 137° C.

SYNTHESIS EXAMPLE 3

Synthesis of Dye Releasing Compound (9)

3-a: N-ethyl-N-hydroxyethyl-3-acetylamino-4-(3,5-dinitro-2-thienylazo)aniline [3-]

18.9 g of 2-amino-3,5-dinitrothiophene was diazotized in a conventional manner at a temperature range between 10° C. and 15° C. using nitrosylsulfuric acid prepared from 7.5 g of sodium nitrite and 50 ml of sulfuric acid. The diazotized solution thus obtained was added to a mixture composed of 22.2 g of 3-acetylamino-N-ethyl-N-hydroxyethylaniline, 220 g of sodium acetate, 300 ml of methyl Cellosolve and 300 ml of water at a temperature range between 10° C. and 15° C. The mixture was stirred at the same temperature range for 30 minutes, 500 ml of water was added, the dark blue colored precipitate thus deposited was collected by filtration and washed with water. The crude product was recrystallized from a solvent mixture of dimethylformamide and methanol to obtain 28.5 g of Compound [3-a].

3-b. Synthesis of N-ethyl-N-benzenesulfonyloxyethyl-3-acetylamino-4-(3,5-dinitro-2-thienylazo)aniline [3-b]

21.1 g of Compound [3-a] was benzenesulfonylated in the same manner as described in Step [1-h] to obtain 16.4 g of Compound [3-b].

3-c: Synthesis of N-ethyl-N-(3-hexadecanoylamino-4-methoxyethoxymethoxy-1-naphthyloxyethyl)-3-acetylamino-4-(3,5-dinitro-2-thienylazo)aniline [3-c]

5 g of Compound [1-f] and 5.6 g of Compound [3-b] were reacted in the same manner as described in Step [1-i] to obtain 4.7 g of Compound [3-c].

3-d: Synthesis of Dye Releasing Compound (9)

3.0 g of Compound [3-c] was subjected to demethoxyethoxymethylation under the same condition as described in Step [1-j] to obtain 2.2 g of Dye Releasing Compound (9) as dark blue colored crystals. m.p. 127° to 131° C.

The 2-acylamino-1-naphthol derivative which is reducing and capable of releasing a dye according to the present invention can be used in a range from 0.01 mol to 10 mols and preferably from 0.01 mol to 1 mol per mol of silver contained in the photographic light-sensitive material.

The 2-acylamino-1-naphthol derivative which is reducing and capable of releasing a dye according to the present invention can be employed in color photographic light-sensitive materials of diffusion transfer type. The color photographic light-sensitive materials of diffusion transfer type include various forms, for example, in which a developing solution is used at around room temperature, in which heat development is utilized, etc. The 2-acylamino-1-naphthol derivative according to the present invention can be effectively used in any of these forms. In the following, preferred embodiments of the photographic light-sensitive material containing the 2-acylamino-1-naphthol derivative are explained in detail.

According to one embodiment of the present invention, the photographic light-sensitive material containing the dye releasing compound includes the following elements:

(1) A support,
(2) A light-sensitive element,
(3) An image-receiving element,
(4) A processing element, and
(5) A developer (in the processing element or in the light-sensitive element).

A specific embodiment which is recommendable is described in British Pat. No. 1,330,524. According to this embodiment, an image receiving layer, a substantially opaque light reflective layer (e.g., a $TiO_2$ layer and a carbon black layer) and a single or a plurality of light-sensitive layers (light-sensitive element) containing the dye releasing compound according to the present invention are successively coated on a transparent support, and furthermore, a transparent cover sheet is overlaid thereon in a surface-to-surface relation. The rupturable container accommodating the alkaline processing composition containing an opacifying agent (e.g., carbon black) for light-shielding is placed adjacent to the uppermost layer (protective layer) of the above light-sensitive layers and the transparent cover sheet:

Such a film unit is exposed through a transparent cover sheet, and when it is removed from a camera, the container is broken by pressing members to cause uniform spreading of the processing solution (including the opacifying agent) between the light-sensitive layer and the cover sheet. Thus, the light-sensitive element is shielded from light in the sandwiched form and the development proceeds in a light place.

For the film unit is this embodiment, it is desirable that a neutralization mechanism be incorporated.

In particular, it is preferred that the neutralization layer be provided in the cover sheet (if desired, a timing layer is provided at the side where the processing solution is spread).

Other useful embodiments in which the dye releasing compound according to the present invention can be used are described in U.S. Pat. Nos. 3,415,644, 3,415,645, 3,415,646, 3,647,487 and 3,635,707, German Patent Application (OLS) No. 2,426,980.

Another embodiment of the color photographic light-sensitive material containing 2-acylamino-1-naphthol derivative according to the present invention is a heat developable color photographic light-sensitive material.

A heat developable color photographic light-sensitive material of diffusion transfer type comprises a light-sensitive element containing (a) light-sensitive silver halide, (b) an organic silver salt oxidizing agent, (c) a reducing agent, (d) a dye releasing compound, (e) a binder and (f) a support, and an image receiving element. According to the present invention, the dye releasing compound of (d) is the reducing 2-acylamino-1-naphthol derivative and the reducing agent of (c) may not be used. In a special case, two functions, i.e., light sensitivity and an oxidizing agent are given to silver halide and the organic silver salt oxidizing agent of (b) is omitted. The light-sensitive element may contain a base generating agent, a silver salt stabilizing agent, a sensitizing dye, an antihalation dye, an irradiation preventing dye, a thermal solvent, etc., if desired.

Examples of useful silver halides include silver chloride, silver chlorobromide, silver chloroiodide, silver bromide, silver iodobromide, silver chloroiodobromide and silver iodide, etc. The details are described in T. H. James, *The Theory of the Photographic Process,* Fourth Edition, Chapter 5, pages 149 to 169. The organic silver salt oxidizing agents which can be preferably used in the present invention include a silver salt of an aliphatic or aromatic carboxylic acid and a silver salt of a nitrogen containing heterocyclic compound. The compounds as described in *Research Disclosure,* Vol. 170, No. 17029 (June, 1978) may be used in the heat-developable color photographic light-sensitive materials according to the present invention.

The heat-developable color photographic light-sensitive material according to the present invention can simultaneously provide a silver iamge having a negative-positive relationship to the original and a diffusible dye on the part corresponding to the silver image by only carrying out heat development after imagewise exposure to light. That is, when the heat-developable color photographic light-sensitive material according to the present invention is imagewise exposed to light and developed by heating, the oxidation-reduction reaction occurs between the organic silver salt oxidizing agent and the reducing agent by means of exposed light-sensitive silver halide as a catalyst to form a silver image in the exposed area. In the step, the dye releasing compound is oxidized upon the organic silver salt oxidizing agent to form an oxidized product. This oxidized product is cleaved in the presence of a dye releasing accelerator and as a result a diffusible dye is released. Consequently, the silver image and the diffusible dye are formed in the exposed area, and a color image can be obtained by transferring the diffusible dye.

The dye releasing accelerator described above is a substance which nucleophilically attacks the oxidized dye releasing compound to release a diffusible dye, and bases, base releasing agents and water releasing compounds are used as the dye releasing accelerators.

The support which can be used in the present invention may function merely as a support but may also have the function of accepting the diffusible dyes released. More specifically, to a synthetic polymer film, paper, glass, etc., which can be resist to the processing temperature, a layer containing a mordant, a nonionic polymer layer, etc., is applied, if desired, to provide the dye acceptability. Also, the dye can be directly applied to a support such as a polyethylene terephthalate film.

The present invention will be explained in greater detail with reference to the following examples, but the present invention should not be construed as being limited thereto.

EXAMPLE 1

A silver benzotriazole emulsion containing light-sensitive silver bromide was prepared in the following manner.

| | | |
|---|---|---|
| (A) | Benzotriazole | 12 g |
| | Isopropyl alcohol | 200 ml |
| (B) | $AgNO_3$ | 17 g |
| | $H_2O$ | 50 ml |
| (C) | LiBr | 2.1 g |
| | Ethanol | 20 ml |

Solution B was added to Solution A with stirring at 40° C.
Solution A became turbid and silver salts of benzotriazole were formed.

To the resulting solution, Solution C was added, by which silver was supplied from the silver benzotriazole to convert a part of silver benzotriazole into silver bromide.

The resulting powdery crystals were collected by filtration and they were added to a polymer solution prepared by dissolving 20 g of polyvinyl butyral in 200 ml of isopropyl alcohol, followed by dispersing for 30 minutes by a homogenizer.

To 10 g of the above described silver benzotriazole emulsion containing light-sensitive silver bromide was added a solution prepared by dissolving 0.50 g of Dye Releasing Compound (1) and 0.22 g of guanidine trichloroacetate in a mixture of 4 ml of ethyl alcohol and 2 ml of N,N-dimethylformamide and stirred. The resulting mixture was applied to a polyethylene terephthalate film having a thickness of 180 μm at a wet film thickness of 100 μm. After the resulting photographic light-sensitive material was dried, it was imagewise exposed at 20,000 luxes for 10 seconds using a tungsten lamp. This imagewise exposed sample was uniformly heated for 120 seconds on a heat block heated at 160° C. After the sample was cooled to room temperature, the coated emulsion layer was mechanically peeled apart from the polyethylene terephthalate film using an adhesive tape. A clear magenta transferred negative image was obtained on the polyethylene terephthalate film. When the density of the magenta negative image was measured by a Macbeth transmission densitometer (TD-504), the maximum density to green light was 1.60 and the minimum density was 0.18. Further, the gradation of the sensitometric curve was a density difference of 0.80 to an exposure difference of 10 times in the straight line part.

EXAMPLE 2

6.5 g of benzotriazole and 10 g of gelatin were dissolved in 1,000 ml of water and the solution was stirred while maintaining the temperature at 50° C. A solution containing 8.5 g of silver nitrate dissolved in 100 ml of water was added to the above described solution over a period of 2 minutes. Then, a solution containing 1.2 g of potassium bromide dissolved in 50 ml of water was added over a period of 2 minutes. By controlling the pH of the emulsion thus prepared precipitate was formed and the excess salts were removed. The pH of the emulsion was then adjusted to 6.0 and 200 g of the emulsion was obtained.

In the following, a method of preparing a gelatin dispersion of a dye releasing compound is described.

A solution prepared by dissolving 15 g of Dye Releasing Compound and 0.5 g of sodium 2-ethylhexylsulfosuccinate as a surface active agent in 20 ml of ethyl acetate and 4 ml of N,N-dimethylformamide was mixed with 100 g of a 10% aqueous gelatin solution with stirring and then dispersed using a homogenizer at 10,000 rpm for 10 minutes. The dispersion thus prepared is designated a dispersion of a dye releasing compound.

In the following, a method of preparing a light-sensitive coating is described.

| | | |
|---|---|---|
| (a) | a silver benzotriazole emulsion containing a light-sensitive silver bromide | 10 g |
| (b) | a dispersion of a dye releasing compound | 3 g |
| (c) | a 5% by weight methanol solution of guanidine trichloroacetate | 2 ml |

The above-described components (a), (b) and (c) were mixed with stirring and the solution was coated on a polyethylene terephthalate film having a thickness of 180μ at a wet thickness of 100 μm and dried. The sample thus prepared was exposed imagewise at 2,000 lux for 10 seconds using a tungsten lamp and then uniformly heated on a heat block which had been heated at 160° C. for 60 seconds. After cooling to room temperature, the emulsion layer was removed and a magenta transferred negative image was obtained on the polyethylene terephthalate film. When the density of the transferred image was measured, the maximum density to green light was 1.45 and the maximum density was 0.15.

EXAMPLE 3

A mixture of 10 g of Dye Releasing Compound (31), 0.5 g of sodium 2-ethylhexylsulfosuccinate as a surface active agent, 4 g of tricresyl phosphate (TCP) and 20 ml of cyclohexanone was heated at about 60° C. to form a uniform solution. The solution was mixed with 100 g of a 10% aqueous solution of lime processed gelatin with stirring and then dispersed using a homogenizer at 10,000 rpm for 10 minutes. The dispersion thus prepared is designated a dispersion of a dye releasing compound.

10 g of a silver benzotriazole emulsion containing a light-sensitive silver bromide same as used in Example 2, 3.5 g of a dispersion of Dye Releasing Compound (31) and a solution containing 110 mg of guanidine trichloroacetate dissolved in 2 ml of methanol were mixed and dissolved. The solution was coated on a polyethylene terephthalate film having a thickness of 180μ at a wet thickness of 60 μm and dried. The sample thus prepared was exposed imagewise at 20,000 lux for 10 seconds using a tungsten lamp and then uniformly heated on a heat block which had been heated at 150° C. for 30 seconds.

In the following, a method of preparing an image receiving material having an image receiving layer is described.

10 g of copolymer of methyl acrylate and N,N,N-trimethyl-N-vinylbenzyl ammonium chloride (a ratio of methyl acrylate and vinyl benzyl ammonium chloride being 1:1) was dissolved in 200 ml of water and the solution was uniformly mixed with 100 g of a 10% aqueous solution of lime processed gelatin. The mixture was uniformly coated on polyethylene terephthalate film at a wet thickness of 20 μm and dried to prepare an image receiving material.

The image receiving material was soaked in water and superposed on the heated light-sensitive material described above in order to bring them into contact with each of the surface layers. After 30 seconds, the image receiving material was peeled apart from the light-sensitive material to obtain a negative magenta color image on the image receiving material. The optical density of the negative image was measured using a Macbeth transmission densitometer (TD-504). The maximum density and the minimum density to green light were 2.20 and 0.12, respectively.

EXAMPLE 4

The same procedure and treatment as described in Example 1 was repeated except using 0.50 g of Dye Releasing Compound (5) in place of Dye Releasing Compound (1). As a result, a yellow transferred color image was obtained on the polyethylene terephthalate film.

EXAMPLE 5

The same procedure and treatment as described in Example 1 was repeated except using 0.5 g of Dye Releasing Compound (9) in place of Dye Releasing Compound (1). As a result, a cyan transferred color image was obtained on the polyethylene terephthalate film.

EXAMPLE 6

On a polyethylene terephthalate transparent support were coated the layers described below in the order listed to prepare a photographic light-sensitive sheet.

(1) Mordanting layer containing 3.0 g/m² of a mordant shown below:

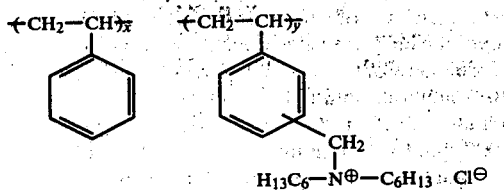

x:y = 50:50 and 3.0 g/m² of gelatin.

(2) White-light-reflective layer containing 20 g/m² of titanium oxide and 2.0 g/m² of gelatin.

(3) Light-shielding layer containing 2.7 g/m² of carbon black and 2.7 g/m² of gelatin.

(4) Layer containing 0.8 g/m² of Dye Releasing Redox Compound (31) according to the present invention, 0.2 g/m² of diethyllaurylamide and 1.08 g/m² of gelatin.

(5) Layer containing a green-sensitive internal latent image type direct reversal silver iodobromide emulsion (halogen composition in the silver halide: 1 mol% of iodide; silver amount: 2.0 g/m²; gelatin: 1.5 g/m²), 0.08 mg/m² of a fogging agent represented by the following formula:

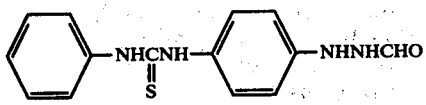

and 0.18 g/m² of sodium 5-pentadecylhydroquinone-2-sulfonate.

(6) Layer containing 0.94 g/m² of gelatin.

Also, a processing solution and a cover sheet shown below were prepared.

| Processing Solution: | |
|---|---|
| 1-Phenyl-4-methyl-4-hydroxymethyl-3-pyrazolidinone | 10 g |
| Methylhydroquinone | 0.18 g |
| 5-Methylbenzotriazole | 4.0 g |
| Sodium Sulfite (anhydrous) | 1.0 g |
| Benzyl Alcohol | 1.5 ml |
| Carboxymethyl Cellulose Na Salt | 40.0 g |
| Carbon Black | 150 g |
| Potassium Hydroxide (28% aq. soln.) | 200 cc |
| $H_2O$ | |

The processing solution of the above composition was filled into a pressure-rupturable container in an amount of 0.8 g.

Cover Sheet:

On a polyethylene terephthalate transparent support were coated a neutralizing acid polymer layer containing 15 g/m² of polyacrylic acid (a 10 wt% aqueous solution having viscosity of about 1,000 cp) and a neutralizing timing layer containing 3.8 g/m² of acetyl cellulose (hydrolysis of 100 g of acetyl cellulose forms 39.4 g of acetyl groups), and 0.2 g/m² of a styrene-maleic anhydride copolymer (composition ratio: styrene:maleic anhydride=about 60:40, molecular weight: about 50,000) to prepare a cover sheet.

The above described cover sheet was super-imposed on the above described light-sensitive sheet. Exposure was performed through a wedge having stepwise different density, from the cover sheet side. Then, the processing solution described above was spread between both sheets in a thickness of 85 microns (the spreading was performed with the assistance of a pressure roller). The processing was carried out at 25° C. Five minutes after processing, the transferred image was observed through the transparent support of the light-sensitive sheet. The magenta transferred color image corresponding to a density of the wedge was obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a layer containing at least one kind of dye releasing 2-acylamino-1-naphthol derivative represented by the following general formula (I):

$$R—L—D \quad (I)$$

wherein R represents a reducing group represented by the following general formula (II):

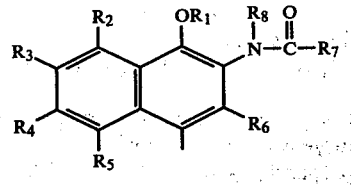

(II)

wherein $R_1$ represents a hydrogen atom or an acyl group having 1 to 12 carbon atoms; $R_2$ to $R_8$, which may be the same or different, each represents a hydrogen atom or a substituent selected from an alkyl group, a cycloalkyl group, an alkenyl group, an aryl group, an alkoxy group, an aryloxy group, an aralkyl group, an acylamino group, an alkylamino group, a dialkylamino group, an arylamino group, a diarylamino group, a halogen atom, an acyloxy group, a hydroxy group, a carboxy group, a cyano group, an acyl group, a carbamoyl group, a substituted carbamoyl group, a sulfamoyl group, a substituted sulfamoyl group, a sulfamoylamino group, a substituted sulfamoylamino group, a ureido group, a substituted ureido group, an alkylsulfonyl group, an arylsulfonyl group, an alkylsulfonylamino group, an arylsulfonylamino group, a sulfamoylamino group, a substituted sulfamoylamino group and a nitro group, and the alkyl moiety or the aryl moiety in the above described substituents may be further substituted with an alkoxy group, an aryloxy group, an acyloxy group, a halogen atom, a hydroxy group, a carboxy group, a cyano group, an acyl group, a sulfamoyl group, a substituted sulfamoyl group, a carbamoyl group, a substituted carbamoyl group, an acylamino group, a ureido group, a substituted ureido group, an alkylsulfonyl group, an arylsulfonyl group, an alkylsulfonylamino group or an arylsulfonylamino group, the groups represented by $R_2$, $R_3$, $R_4$ or $R_5$ may contain up to 12 carbon atoms, and groups represented by $R_6$, $R_7$ or $R_8$ may contain up to 22 carbon atoms and at least one of them should contain not smaller than 8 carbon atoms; L represents a divalent connecting group between R and D selected from the group represented by the following formulae:

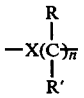
n = [0~3] 0, 1, 2 or 3

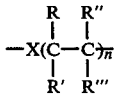
n = [1~2] 1 or 2

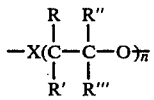
n = [1~2] 1 or 2

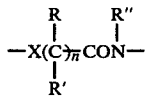
n = [0~3] 0, 1, 2 or 3

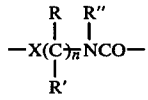
n = [1~3] 1, 2 or 3

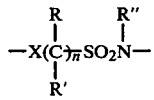
n = [0~3] 0, 1, 2 or 3

-continued

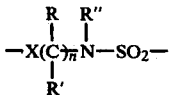
n = [1~3] 1, 2 or 3

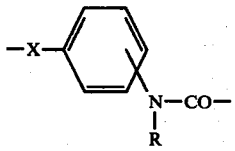

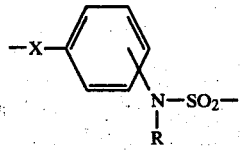

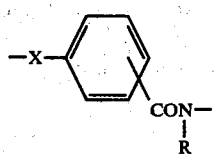

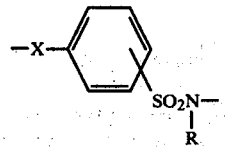

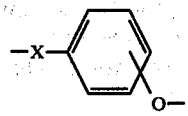

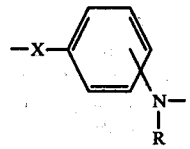

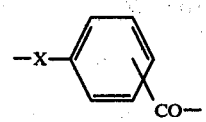

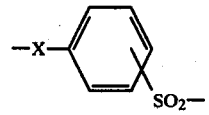

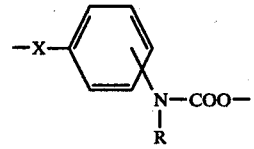

-continued

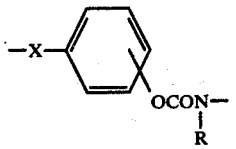

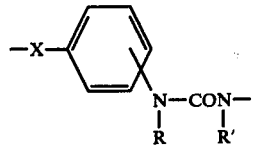

wherein R, R′, R″ and R‴, which may be the same or different, each represents a hydrogen atom or a substituent selected from a methyl group, an ethyl group, a hydroxymethyl group, a methoxymethyl group, a carboxymethyl group, a cyanomethyl group, a hydroxyethyl group, a methoxyethyl group, a carboxyethyl group and a cyanoethyl group; the benzene ring may be further substituted with an alkyl group, an alkoxy group, a halogen atom or a hydroxy group; and X represents —O—, —S—,

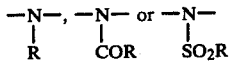

(wherein R has the same meaning as defined above); and D represents a dye or a precursor of dye.

2. A color photographic light-sensitive material as claimed in claim 1, wherein the reducing group represented by R has an oxidation reduction potential to a saturated calomel electrode of 1.2 v or less measuring the polarographic half wave potential using acetonitrile as a solvent and sodium perchlorate as a supporting electrolyte.

3. A color photographic light-sensitive material as claimed in claim 1, wherein the reducing group represented by R contains a ballast group.

4. A color photographic light-sensitive material as claimed in claim 3, wherein the ballast group is a hydrophobic group containing 10 or more carbon atoms.

5. A color photographic light-sensitive material as claimed in claim 1, wherein the divalent connecting group represented by L is a group which bonds to the reducing group represented by R through an oxygen atom and contains a total number of carbon atoms of not more than 12.

6. A color photographic light-sensitive material as claimed in claim 1, wherein the dye portion represented by D is selected from the group of dyes consisting of an azo dye, an azomethine dye, an anthraquinone dye, a naphthoquinone dye, a styryl dye, a quinophthalone dye, an indigoid dye, a carbonium ion dye or a phthalocyanine dye.

7. A color photographic light-sensitive material as claimed in claim 6, wherein the dye included in the dye portion represented by D is selected from the group of dyes having the following general formulae:

Yellow:

-continued

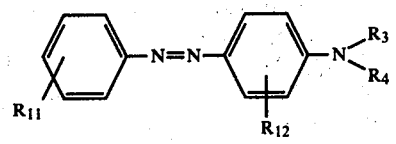

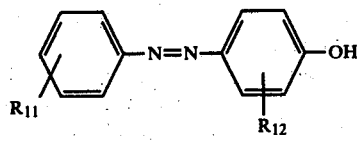

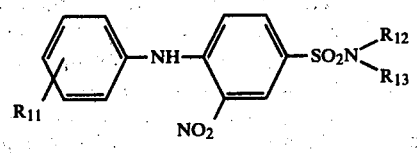

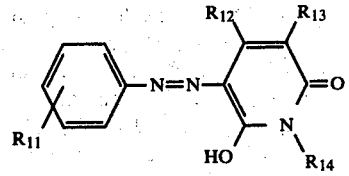

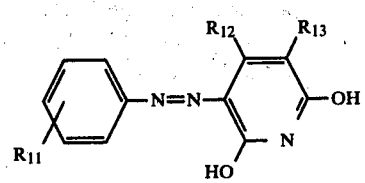

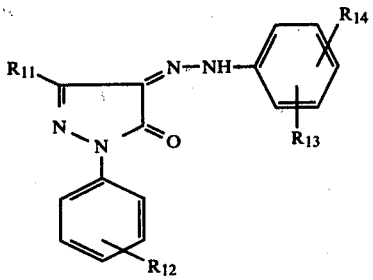

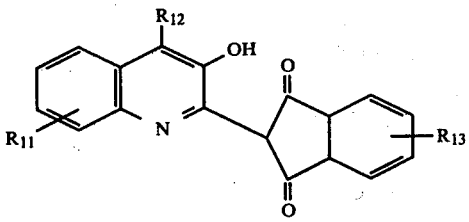

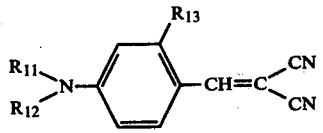

-continued
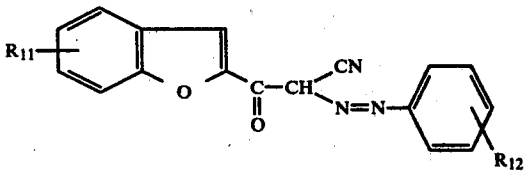
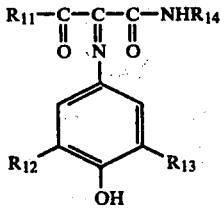
Magenta:
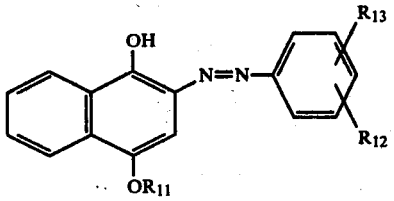
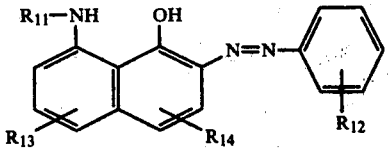
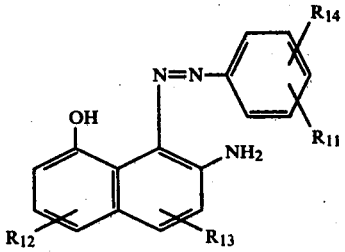
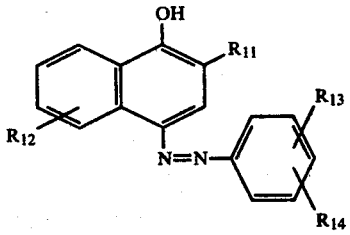
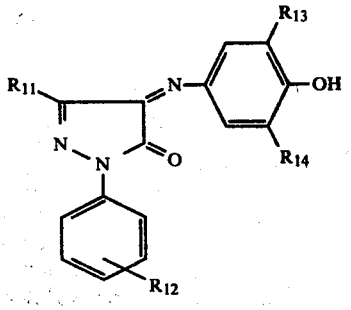
-continued
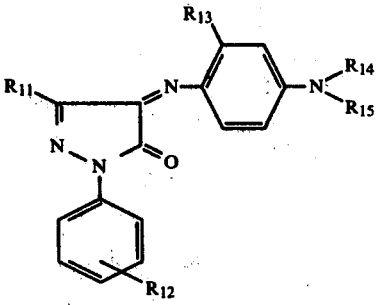
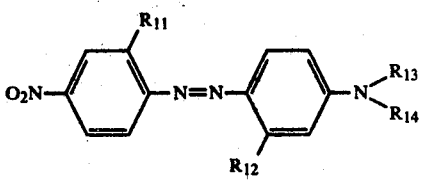
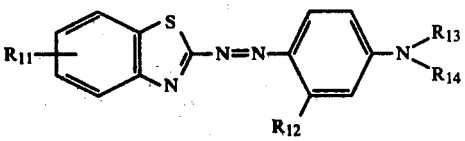
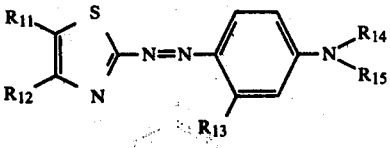
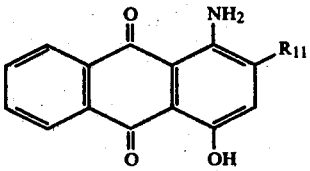
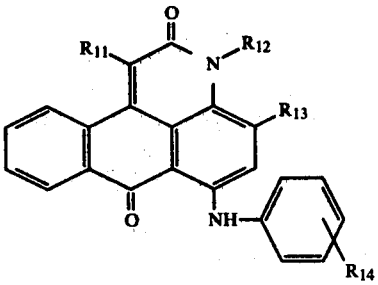
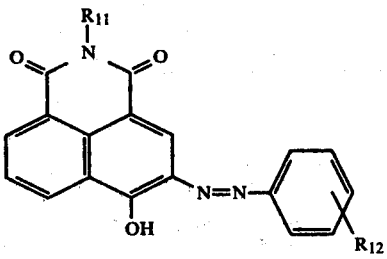
Cyan:

-continued

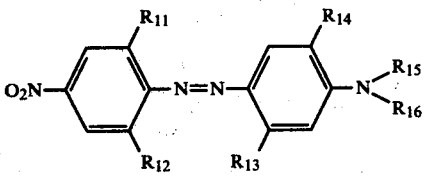

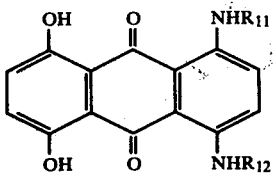

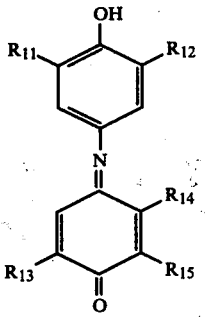

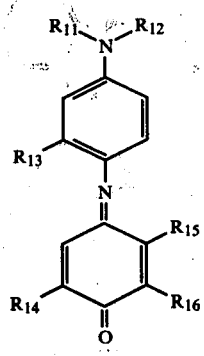

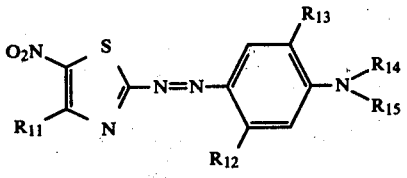

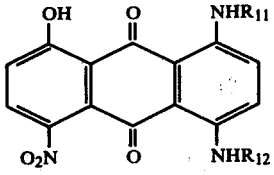

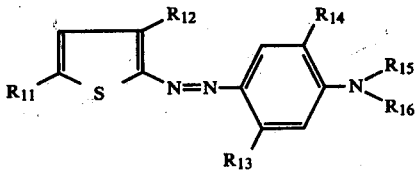

-continued

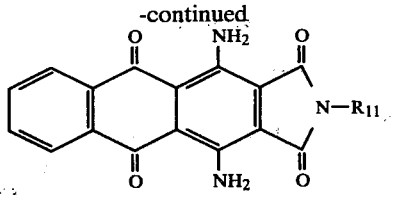

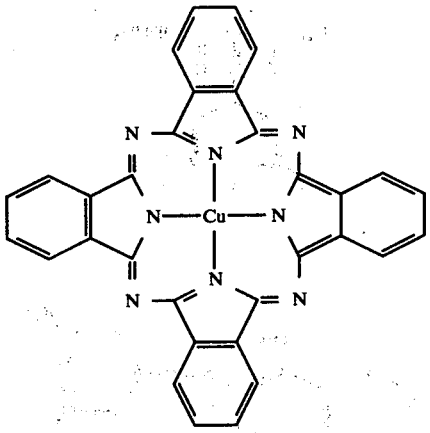

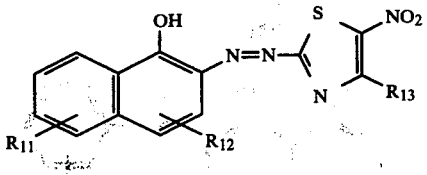

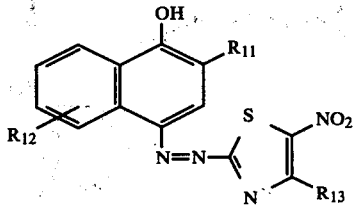

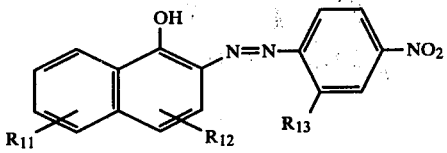

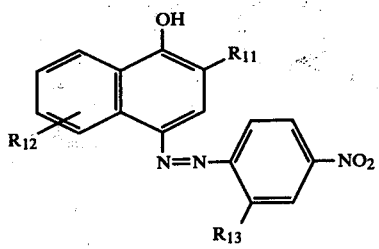

wherein $R_{11}$ to $R_{16}$, which may be the same or different, each represents a hydrogen atom or a substituent selected from the group consisting of an alkyl group having 1 to 12 carbon atoms, a cycloalkyl group having 5 to 12 carbon atoms, an aralkyl group having 7 to 12 carbon atoms, an alkoxy group having 1 to 12 carbon atoms, an aryloxy group having 6 to 12 carbon atoms, an aryl group having 6 to 12 carbon atoms, an acylamino group having 1 to 22 carbon atoms, an acyl group having 1 to 12 carbon atoms, a cyano group, a hydroxy group, an alkylsulfonylamino group having 1 to 12 carbon atoms, an arylsulfonylamino group having 6 to 12 carbon atoms, an alkylsulfonyl group having 1 to 12 carbon atoms, a hydroxyalkyl group having 1 to 12 carbon atoms, a cyanoalkyl group having 2 to 12 carbon atoms, an alkoxycarbonylalkyl group having 3 to 12 carbon atoms, an alkoxyalkyl group having 2 to 12 carbon atoms, an aryloxyalkyl group having 7 to 12 carbon atoms, a nitro group, a halogen atom, a sulfamoyl group, an N-substituted sulfamoyl group having 1 to 12 carbon atoms, a carbamoyl group, an N-substituted carbamoyl group having 1 to 12 carbon atoms, an acyloxyalkyl group having 2 to 12 carbon atoms, an amino group, a substituted amino group having 1 to 12 carbon atoms, an alkylthio group having 1 to 12 carbon atoms, and an arylthio group having 6 to 12 carbon atoms.

8. A color photographic light-sensitive material as claimed in claim 1, wherein the dye portion represented by D does not contain a group which hinders tinting of an image receiving sheet.

9. A color photographic light-sensitive material as claimed in claim 1, wherein the light-sensitive silver halide is selected from the group consisting of silver chloride, silver chlorobromide, silver chloroiodide, silver bromide, silver iodobromide, silver chloroiodobromide or silver iodide.

10. A color photographic light-sensitive material as claimed in claim 1, wherein the color photographic light-sensitive material comprises a transparent support having thereon an image receiving layer, a substantially opaque light reflective layer, a layer containing at least one kind of the dye releasing 2-acylamino-1-naphthol derivative represented by the general formula (I), a light-sensitive silver halide emulsion layer.

11. A color photographic light-sensitive material as claimed in claim 1, wherein the color photographic light-sensitive material is a heat-developable color photographic light-sensitive material.

12. A color photographic light-sensitive material as claimed in claim 1, wherein the color photographic light-sensitive material is a heat-developable color photographic light-sensitive material.

13. A color photographic light-sensitive material as claimed in claim 1, further comprising a layer containing a light-sensitive silver halide, an organic silver salt oxidizing agent, and a binder.

14. A color photographic light-sensitive material as claimed in claim 1, wherein the color photographic light-sensitive material further contains a reducing agent.

15. A color photographic light-sensitive material as claimed in claim 1, wherein an amount of the dye releasing compound represented by the general formula (I) is from 0.01 mol to 10 mols per mol of silver contained therein.

16. A color photographic light-sensitive material as claimed in claim 15, wherein an amount of the dye releasing compound is from 0.01 mol to 1 mol per mol of silver contained therein.

17. A color photographic light-sensitive material as claimed in claim 13, wherein the organic silver salt oxidizing agent is a silver salt of an aliphatic or aromatic carboxylic acid or a silver salt of a nitrogen containing heterocyclic compound.

18. A color photographic light-sensitive material as claimed in claim 13, wherein the color photographic light-sensitive material further contains a dye releasing accelerator.

19. A color photographic light-sensitive material as claimed in claim 18, wherein the dye releasing accelerator is a compound which nucleophilically attacks an oxidized product of the dye releasing compound to release a diffusible dye.

20. A color photographic light-sensitive material as claimed in claim 18, wherein the dye releasing accelerator is selected from the group consisting of a base, a base releasing agent and a water releasing compound.

21. A color photographic light-sensitive material as claimed in claim 13, wherein the binder is gelatin.

22. A method of forming a color image comprising:

(1) imagewise exposing a silver halide color photographic light-sensitive material comprising a support having thereon a layer containing at least one kind of dye releasing 2-acylamino-1-naphthol derivative represented by the following general formula (I):

$$R—L—D \qquad (I)$$

wherein R represents a reducing group represented by the following general formula (II):

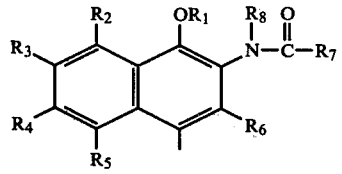

(II)

wherein $R_1$ represents a hydrogen atom or an acyl group having 1 to 12 carbon atoms; $R_2$ to $R_8$, which may be the same or different, each represents a hydrogen atom or a substituent selected from an alkyl group, a cycloalkyl group, an alkenyl group, an aryl group, an alkoxy group, an aryloxy group, an aralkyl group, an acylamino group, an alkylamino group, a dialkylamino group, an arylamino group, a diarylamino group, a halogen atom, an acyloxy group, a hydroxy group, a carboxy group, a cyano group, an acyl group, a carbonyl group, a substituted carbamoyl group, a sulfamoyl group, a substituted sulfamoyl group, a sulfamoylamino group, a substituted sulfamoylamino group, a ureido group, a substituted ureido group, an alkylsulfonyl group, an arylsulfonyl group, an alkylsulfonylamino group, an arylsulfonylamino group, a sulfamoylamino group, a substituted sulfamoylamino group and a nitro group, and the alkyl moiety or the aryl moiety in the above described substituents may be further substituted with an alkoxy group, an aryloxy group, an acyloxy group, a halogen atom, a hydroxy group, a carboxy group, a cyano group, an acyl group, a sulfamoyl group, a substituted sulfamoyl group, a carbamoyl group, a substituted carbamoyl group, an acylamino group, a ureido group, a substituted ureido group, an alkylsulfonyl group, an arylsulfonyl group, an alkylsulfonylamino group or an arylsulfonylamino group; the groups represented by $R_2$, $R_3$, $R_4$ or $R_5$ may contain up to 12 carbon atoms, and groups represented by $R_6$, $R_7$ or $R_8$ may contain up to 22 carbon atoms and at least one of them should contain not smaller than 8 carbon atoms; L represents a divalent connecting group between R and D selected from the group represented by the following formulae:

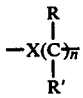

n = [0~3] 0, 1, 2 or 3

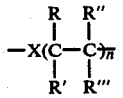

n = [1~2] 1 or 2

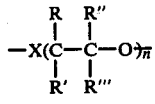

n = [1~2] 1 or 2

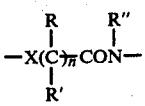

n = [0~3] 0, 1, 2 or 3

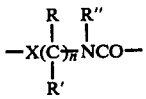

n = [1~3] 1, 2 or 3

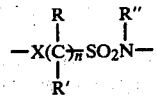

n = [0~3] 0, 1, 2 or 3

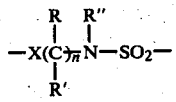

n = [1~3] 1, 2 or 3

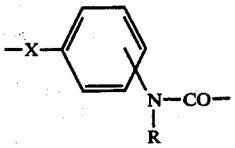

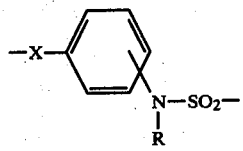

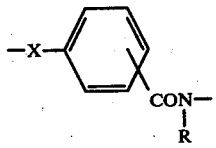

-continued

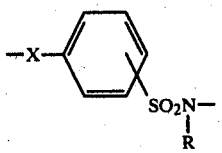

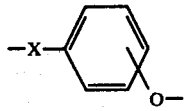

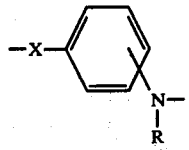

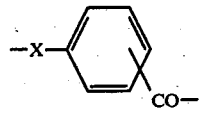

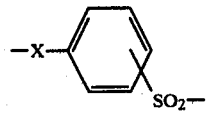

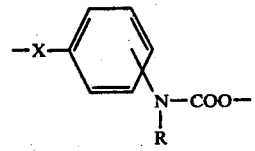

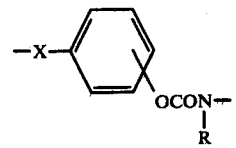

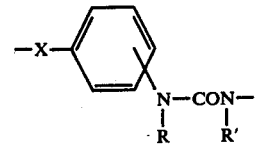

wherein R, R', R'' and R''', which may be the same or different, each represents a hydrogen atom or a substituent selected from a methyl group, an ethyl group, a hydroxymethyl group, a methoxymethyl group, a carboxymethyl group, a cyanomethyl group, a hydroxyethyl group, a methoxyethyl group, a carboxyethyl group and a cyanoethyl group; the benzene ring may be further substituted with an alkyl group, an alkoxy group, a halogen atom or a hydroxy group; and X represents —O—, —S—,

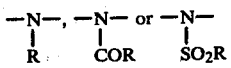

(wherein R has the same meaning as defined above); and D represents a dye or a precursor of dye, (2) developing the exposed photographic material to release a diffusible dye and diffusing the diffusible dye into a dye receiving layer.

23. A method of forming a color image as claimed in claim 22, wherein the development is carried out using an alkaline processing solution.

24. A method of forming a color image as claimed in claim 22, wherein the development is carried out by heating.

25. A method of forming a color image as claimed in claim 22, wherein the diffusible dye is transferred into an image receiving layer containing a mordant.

26. A method of forming a color image as claimed in claim 22, wherein the diffusible dye is transferred into a support which is dye acceptable.

* * * * *